US011536086B2

(12) United States Patent
Miller et al.

(10) Patent No.: US 11,536,086 B2
(45) **Date of Patent: *Dec. 27, 2022**

(54) BASE SLAT PRY STOPPER

(71) Applicant: Qualitas Manufacturing, Inc., Itasca, IL (US)

(72) Inventors: James V. Miller, Glen Ellyn, IL (US); Miguel Hernandez, Chicago, IL (US)

(73) Assignee: Qualitas Manufacturing, Inc., Itasca, IL (US)

( * ) Notice: Subject to any disclaimer, the term of this patent is extended or adjusted under 35 U.S.C. 154(b) by 933 days.

This patent is subject to a terminal disclaimer.

(21) Appl. No.: 16/013,393

(22) Filed: Jun. 20, 2018

(65) Prior Publication Data

US 2019/0390516 A1 Dec. 26, 2019

(51) Int. Cl.
*E06B 9/80* (2006.01)
*E06B 9/58* (2006.01)
(Continued)

(52) U.S. Cl.
CPC ..... *E06B 9/80* (2013.01); *E06B 9/17* (2013.01); *E06B 9/581* (2013.01); *E06B 2009/005* (2013.01); *E06B 2009/801* (2013.01)

(58) Field of Classification Search
CPC ..... E06B 9/15; E06B 2009/1516; E06B 2009/1522; E06B 2009/1533;
(Continued)

(56) References Cited

U.S. PATENT DOCUMENTS 3,850,465 A * 11/1974 Hill ..... E06B 9/165 292/231
4,035,008 A * 7/1977 Hardt ..... E06B 9/165 292/227
(Continued)

FOREIGN PATENT DOCUMENTS

CN 2006257640 A 9/2006
EP 3208409 A1 8/2017
(Continued)

OTHER PUBLICATIONS

International Search Report & Written Opinion related to Application No. PCT/US2019/038294; dated Oct. 22, 2019.

*Primary Examiner* — Daniel P Cahn
*Assistant Examiner* — Jeremy C Ramsey
(74) *Attorney, Agent, or Firm* — von Briesen & Roper, s.c.

(57) ABSTRACT

A base slat pry stopper, such as a base slat locking bracket, for locking a rolling shutter curtain covering an opening of a structure is disclosed. The base slat pry stopper may include a bracket base plate mounted to an opening bottom wall on an interior side of the shutter curtain, and a base slat engagement portion extending upward from the bracket base plate and above a top surface of the opening bottom wall. When the shutter curtain is unrolled to cover the opening, the base slat engagement portion engages the base slat to prevent the base slat from deflecting upward away from the opening bottom wall when a force applied from an exterior side of the shutter curtain causes the base slat to deflect toward the interior side of the structure and the shutter curtain. The base slat pry stopper may be permanently or removably installed.

19 Claims, 14 Drawing Sheets

(51) Int. Cl.
*E06B 9/17* (2006.01)
*E06B 9/00* (2006.01)

(58) Field of Classification Search
CPC ..... E06B 2009/1538; E06B 2009/801; E06B 9/80; E06B 2009/802; E06B 2009/804; E06B 2009/805; E06B 2009/005; Y10S 292/36; Y10S 292/15; Y01T 292/03; Y01T 292/65; Y01T 292/67; Y01T 292/34
See application file for complete search history.

(56) References Cited

U.S. PATENT DOCUMENTS 4,573,512 A * 3/1986 Lichy ..... E06B 9/86 160/133
5,070,925 A 12/1991 Paule
5,253,694 A 10/1993 Bernardo
5,573,050 A * 11/1996 Henkenjohann ..... E06B 9/86 160/133
5,575,322 A 11/1996 Miller
5,819,834 A * 10/1998 Wedekind ..... E05B 65/0021 160/209
5,839,493 A 11/1998 Quasius
5,850,862 A 12/1998 Miller
5,938,136 A 8/1999 Miller
5,975,185 A 11/1999 Miller et al.
5,983,971 A 11/1999 Miller et al.
5,996,669 A 12/1999 Miller
6,021,837 A 2/2000 Miller
6,054,921 A 4/2000 Miller
6,085,822 A 7/2000 Miller
6,095,224 A 8/2000 Miller
6,095,225 A 8/2000 Miller
6,244,325 B1 6/2001 Miller et al.
6,263,942 B1 7/2001 Miller
6,302,179 B1 10/2001 Miller
6,422,289 B1 7/2002 Miller
6,453,975 B2 9/2002 Miller
6,742,563 B2 * 6/2004 Belanger ..... E06B 9/18 160/133
7,086,443 B2 * 8/2006 Williams ..... E06B 3/485 160/209
7,100,665 B2 9/2006 Miller
7,299,850 B2 11/2007 Miller
7,357,171 B2 4/2008 Miller
7,409,980 B1 8/2008 Heissenberg
7,784,522 B2 8/2010 Miller
8,171,681 B2 5/2012 Miller
8,490,670 B2 7/2013 Miller
8,616,261 B2 12/2013 Miller
8,746,321 B2 6/2014 Miller
8,925,617 B2 1/2015 Miller
8,944,137 B2 2/2015 Miller
9,074,411 B2 7/2015 Miller et al.
9,309,715 B2 4/2016 Miller et al.
2005/0082020 A1 4/2005 Miller
2006/0237151 A1 10/2006 Miller
2007/0131358 A1 * 6/2007 Iwasaki ..... E06B 9/58 160/133
2007/0199662 A1 8/2007 Miller
2008/0016798 A1 1/2008 Miller
2008/0017329 A1 1/2008 Miller
2008/0202700 A1 8/2008 Miller
2011/0162807 A1 7/2011 Miller
2012/0273141 A1 11/2012 Miller et al.
2012/0273142 A1 11/2012 Miller et al.
2013/0193695 A1 * 8/2013 Taylor ..... E05C 17/60 292/137
2014/0231029 A1 8/2014 Miller
2015/0101762 A1 4/2015 Miller et al.

FOREIGN PATENT DOCUMENTS

GB 2253436 A 9/1992
KR 19980065184 U 11/1998
KR 101076822 B1 10/2011

* cited by examiner

BASE SLAT PRY STOPPER

TECHNICAL FIELD

The present disclosure relates generally to rolling shutter assemblies and, more particularly, to security structures in rolling shutter assemblies to prevent ingress through openings of structures covered by the rolling shutter assemblies.

BACKGROUND

Rolling protective shutters are conventional and are used to provide protection against extreme weather conditions and to deter theft, for example. One such rolling protective shutter assembly is disclosed in U.S. Pat. No. 6,095,224 to Miller (hereinafter "the Miller '224 patent"). As shown in FIGS. 1 and 2 of the Miller '224 patent, a rolling shutter assembly is composed of a shutter support member, a shutter curtain formed by a plurality of elongate slats interconnected by a plurality of elongate hinges, and side tracks mounted on either side of an opening. When not in use, the shutter curtain may be rolled up onto the shutter support member within a housing disposed mounted above the opening. When the shutter curtain is unrolled to its protective position, each of the slats is disposed vertically with ends of the slats disposed within the side tracks on either side of the opening. The ends of the slats can include extension members attached thereto that are engaged by fins within the side tracks to prevent the ends of the slats from being pulled out of the side tracks. A bottommost or base slat of the shutter curtain has an extendable lock arm at either end that can be extended when the shutter curtain is in the protective position and received by corresponding openings within the side tracks to prevent the shutter curtain from being lifted and allowing ingress through the opening.

The base slat can typically only be attached to the side tracks with similar locking mechanisms that slide from the base slat into the side tracks and are received by openings therein. In such arrangements, the engagement of the lock arms within the side track openings provides the only two points of contact for locking or securing the base slat. Due to the flexibility of the base slat, especially as the width of the shutter curtain increases, the shutter security can be compromised in some installations by a pry bar or crow bar being inserted under the base slate, and the base slat being pried up to allow a breach of the security of the shutter curtain. Once the security is breached, access into the structure can be gained through the opening, leaving property therein susceptible to vandalism and theft.

SUMMARY OF THE DISCLOSURE

In one aspect of the present disclosure, a rolling shutter assembly for covering an opening of a structure is disclosed. The opening may have an opening top wall, an opening bottom wall and oppositely disposed opening side walls. The rolling shutter assembly may include a shutter support member mounted at the opening top wall, a shutter curtain coupled to the shutter support member, the shutter curtain comprising a plurality of individual slats and a plurality of hinges interconnecting the plurality of individual slats, with a bottommost slat being a base slat, and a pair of side tracks each having a U-shaped channel Each of the pair of side tracks is mounted to a corresponding one of the opening side walls such that ends of the plurality of individual slats are received within the U-shaped channels when the shutter curtain is unrolled from the shutter support member to cover the opening, and wherein the base slat is disposed proximate the opening bottom wall when the shutter curtain is unrolled. The rolling shutter assembly further includes a base slat locking bracket mounted to the opening bottom wall on an interior side of the structure and the shutter curtain. The base slat locking bracket is positioned so that the base slat can move upward and downward past the base slat locking bracket when the shutter curtain is rolled onto and unrolled from the shutter support member, and the base slat locking bracket receives and engages the base slat to prevent the base slat from deflecting upward away from the opening bottom wall when a force applied from an exterior side of the shutter curtain causes the base slat to deflect toward the interior side of the structure and the shutter curtain.

In another aspect of the present disclosure, a method for covering an opening of a structure to prevent ingress into the structure through the opening is disclosed. A rolling shutter assembly is mounted at the opening, the rolling shutter assembly having a shutter support member mounted at an opening top wall, a shutter curtain coupled to the shutter support member and having a plurality of individual slats and a plurality of hinges interconnecting the plurality of individual slats, with a bottommost slat being a base slat, and a pair of side tracks each having a U-shaped channel, each of the pair of side tracks mounted to a corresponding one of opening side walls such that ends of the plurality of individual slats are received within the U-shaped channels when the shutter curtain is unrolled from the shutter support member to cover the opening, and wherein the base slat is disposed proximate an opening bottom wall when the shutter curtain is unrolled. The method for covering includes mounting a base slat locking bracket to the opening bottom wall on an interior side of the structure and the shutter curtain, wherein the base slat locking bracket is positioned so that the base slat can move upward and downward past the base slat locking bracket when the shutter curtain is rolled onto and unrolled from the shutter support member, and engaging the base slat by the base slat locking bracket to prevent the base slat from deflecting upward away from the opening bottom wall when the shutter curtain is unrolled and a force applied from an exterior side of the shutter curtain causes the base slat to deflect toward the interior side of the structure and the shutter curtain.

In a further aspect of the present disclosure, a base slat locking bracket for locking a rolling shutter assembly installed to cover an opening of a structure is disclosed. The opening has an opening top wall, an opening bottom wall and oppositely disposed opening side walls. The rolling shutter assembly includes a shutter support member mounted at the opening top wall, a shutter curtain coupled to the shutter support member, the shutter curtain comprising a plurality of individual slats and a plurality of hinges interconnecting the plurality of individual slats, with a bottommost slat being a base slat extending inward toward an interior of the structure and the shutter curtain, and a pair of side tracks each having a U-shaped channel, each of the pair of side tracks mounted to a corresponding one of the opening side walls such that ends of the plurality of individual slats are received within the U-shaped channels when the shutter curtain is unrolled from the shutter support member to cover the opening, and wherein the base slat is disposed proximate the opening bottom wall when the shutter curtain is unrolled. The base slat locking bracket including a bracket base plate mounted to the opening bottom wall on an interior side of the structure and the shutter curtain, and a base slat engagement portion extending upward from the bracket base plate and above a top surface of the opening bottom wall. The base slat engagement portion is positioned so that the base slat can move upward and downward past the base slat locking bracket when the shutter curtain is rolled onto and unrolled from the shutter support member, and the base slat engagement portion engages the base slat to prevent the base slat from deflecting upward away from the opening bottom wall when a force applied from an exterior side of the shutter curtain causes the base slat to deflect toward the interior side of the structure and the shutter curtain.

Additional aspects are defined by the claims of this patent.

DETAILED DESCRIPTION

Figure 1:
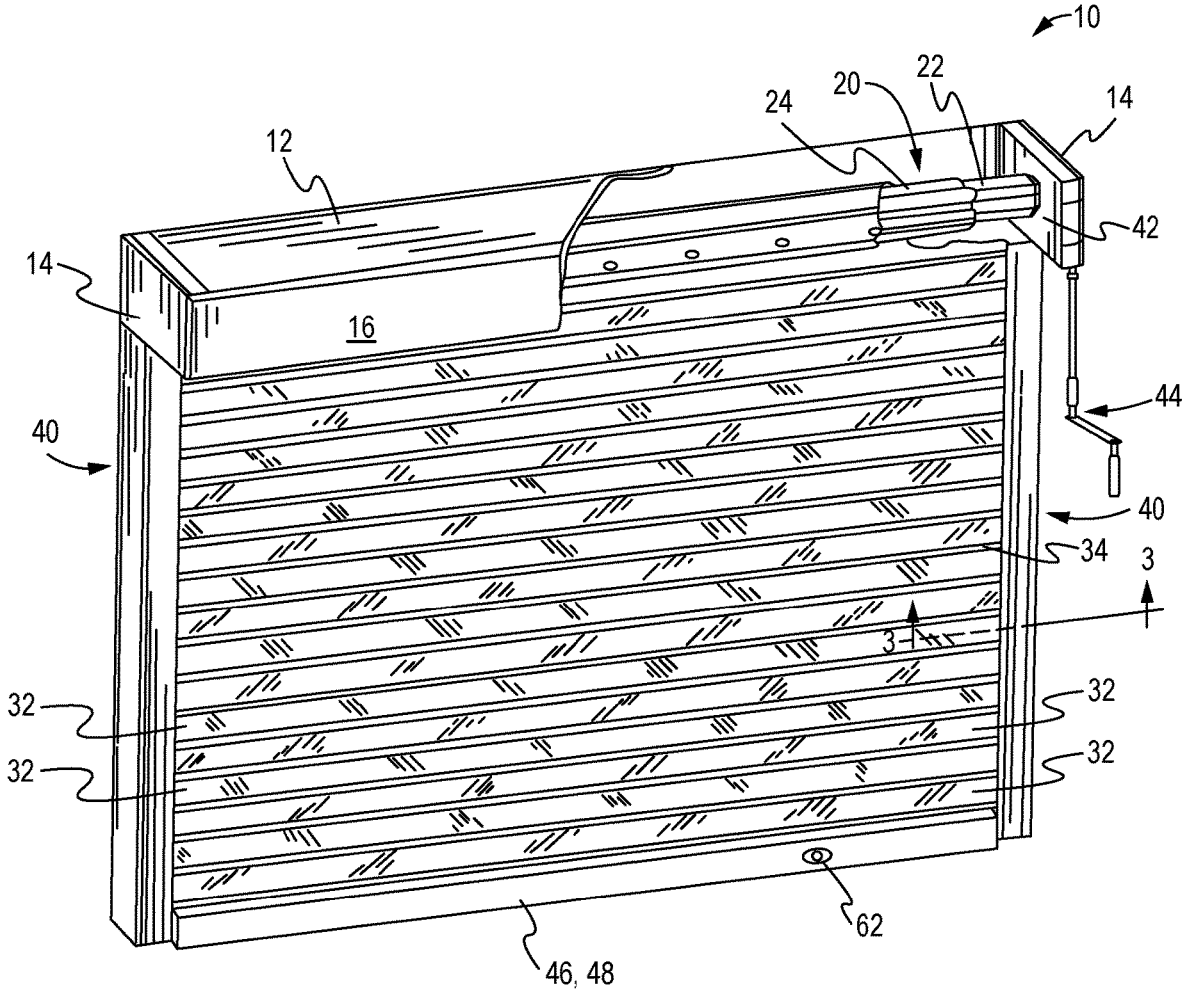
FIG. 1 is an isometric view of a rolling shutter assembly that can implement a base slat pry stopper in accordance with the present disclosure.

One type of a rolling shutter assembly 10 that may implement a base slat pry stopper in accordance with the present disclosure is shown in FIGS. 1-5. Referring to FIG. 1, the rolling shutter assembly 10 has a shutter housing which includes a top wall 12, a pair of side walls or end caps 14, a front wall 16, a rear wall 18 and a bottom wall (not shown). In many implementations, the top wall 12, rear wall 18 and an upper portion of the front wall 16 are formed as a first housing component, and the remainder of the front wall 16 and the bottom wall are formed as a second housing component to facilitate installation of the rolling shutter assembly 10. A shutter support member 20 is mounted for rotation within the shutter housing. The shutter support member 20 includes a generally cylindrical central shaft 22 and a plurality of mounting members 24 fixed to the central shaft 22.

Figure 2:
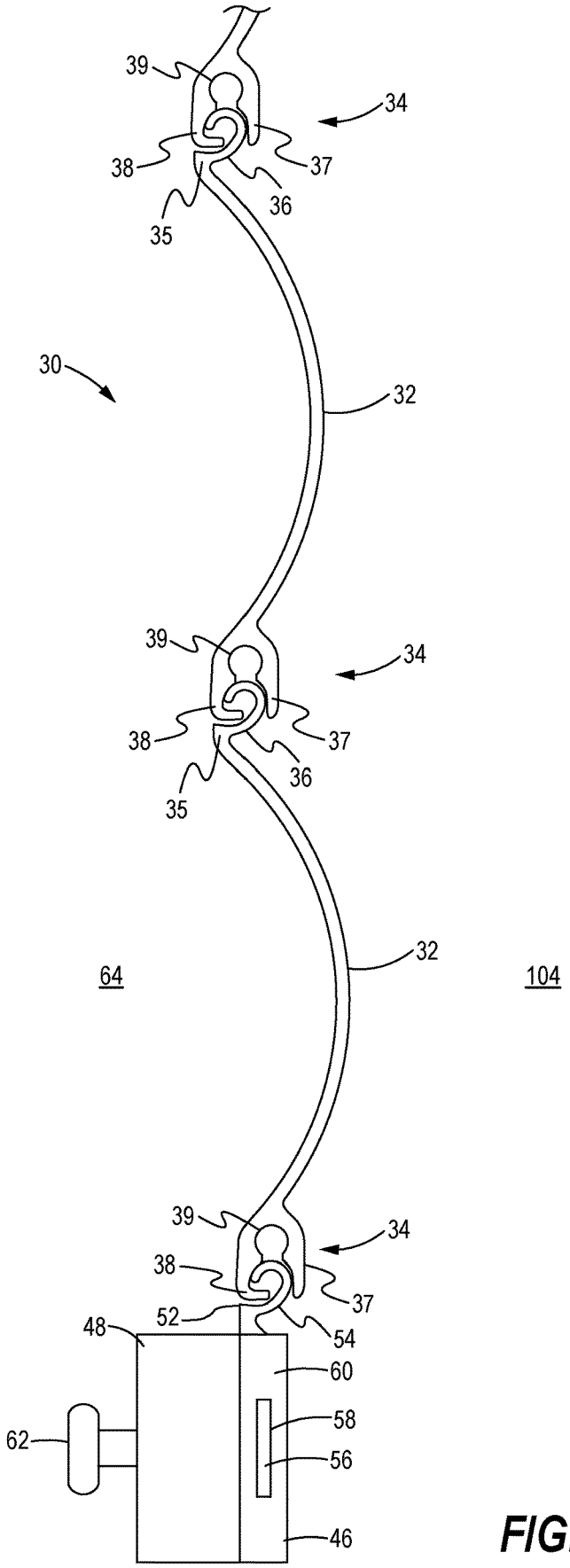
FIG. 2 is a side view of a portion of a shutter curtain of the rolling shutter assembly of FIG. 1.

The upper end of a rolling shutter curtain 30 is coupled to one or more of the mounting members 24. The rolling shutter curtain 30 is composed of a plurality of individual, elongate slats 32. One example of a configuration of the shutter curtain 30 with the slats 32 is illustrated in FIG. 2. The slats 32, each of which may have a curved cross-section to facilitate wrapping around the shutter support member 20, and may be composed of steel, aluminum, or other appropriate material, are interconnected by a plurality of hinges 34, each of which joins together a pair of adjacent slats 32. Each of the slats 32 includes an upward projection 35 extending longitudinally along the upper edge of the slat 32 and having a rearward and upward extending hook 36 at the top. Each of the slats 32 further includes a downward facing generally U-shaped recess 37 extending longitudinally along the lower edge of the slat 32 and having a forward horizontal projection 38 formed on one edge of the recess 37 and extending partially across the open end of the recess 37. The hook 36 of a lower slat 32 and the recess 37 and the projection 38 of an upper slat 32 interlock to form each hinge 34. The recess 37 may further be formed with a semi-circular portion 39 forming an integral screw boss for engaging an end retention member 50 (FIG. 3) that will in turn engage the corresponding side track 40 (FIGS. 1 and 3) of the rolling shutter assembly 10 to retain the rolling shutter curtain 30 within the side tracks 40. This shutter slat configuration is illustrated and described more fully in U.S. Pat. No. 7,357,171 (hereinafter "the Miller '171 patent"), which is expressly incorporated by reference herein for all purposes. Other examples of shutter assemblies with end retention are shown in the Miller '224 patent and U.S. Pat. No. 6,095,225 (hereinafter "the Miller '225 patent"), which are expressly incorporated by reference herein for all purposes. Other configurations of slats and interconnecting hinges are well known in the art and are contemplated by the inventor as having use in rolling shutter assemblies 10 in accordance with the present disclosure.

Referring back to FIG. 1, the ends of the slats 32 are disposed within a pair of side tracks 40 having U-shaped channels. The rolling shutter assembly 10 may include a drive motor housing 42 at one of the end caps 14 containing a reversible drive motor, such as a tubular operator (not shown), connected to the central shaft 22 to rotate the central shaft 22 in either direction to raise and lower the rolling shutter curtain 30. The drive motor housing 42 may also include a gear assembly (not shown) connected to the central shaft 22 with a removable hand crank 44 for manually raising and lowering the rolling shutter curtain 30 in the event of a failure of the drive motor, such as during a power outage. When mounted to protect a window or other opening, the side tracks 40 of the rolling shutter assembly 10 are positioned on either side of the opening and the shutter housing is positioned over the top of the opening. Alternatively, in some applications, the side tracks 40 and shutter housing are positioned within the opening. When the rolling shutter curtain 30 is not in use, it is rolled up on the shutter support member 20 via the drive motor or, if necessary, the hand crank 44 so that it is at least partially enclosed by the shutter housing.

Using the drive motor or the hand crank 44, the rolling shutter curtain 30 is rolled up into the shutter housing until a base slat 46 and its base slat body 48 are disposed at the shutter housing, or unrolled from the shutter support member 20 until the base slat 46 is disposed proximate a bottom surface of the opening. The base slat 46 is illustrated in greater detail in FIG. 2. The base slat 46 may have a generally rectangular cross-section for strength and to prevent the base slat 46 from twisting within the side track 40. The base slat 46 includes an upward projection 52 and a hook 54 similar to the upward projections 35 and hooks 36 of the slats 32 extending longitudinally along the upper edge of the base slat 46 so that the hook 54 may interlock with the recess 37 and the projection 38 of the bottommost slat 32 of the rolling shutter curtain 30 to form the bottommost hinge 34.

The base slat 46 further includes a locking mechanism for selective engagement of the side tracks 40 to substantially prevent the rolling shutter curtain 30 from being raised when in the unrolled position shown in FIG. 1 to prevent access through the opening. In the illustrated base slat 46, lock arms 56 at either end of the base slat 46 are extendable and retractable through arm openings 58 in base slat end walls 60. A conventional key lock 62 that is accessible from an interior side 64 of the shutter curtain 30 and the opening covered by the rolling shutter assembly 10 may be operatively coupled to the lock arms 56 by linkages or other connecting structures (not shown) within the base slat 46. The key lock 62 is movable between an unlocked position in which the lock arms 56 are retracted into the base slat 46 and a locked position in which the lock arms 56 extend out from the base slat end walls 60 are engaged by the side tracks 40 as described further below. Depending on the implementation, the base slat 46 may have a single key lock 62 that is operatively connected to both lock arms 56 as shown in FIG. 1, or may have a separate key lock 62 at each end operatively connected to the corresponding lock arm 56.

Figure 3:
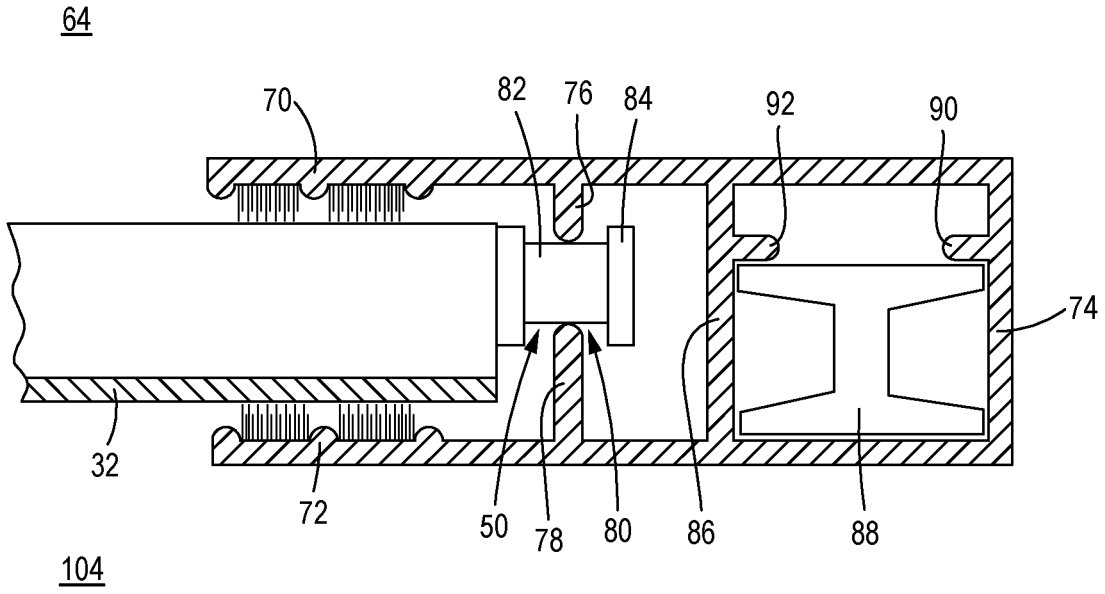
FIG. 3 is a cross-sectional bottom view of a portion of the rolling shutter assembly of FIG. 1 taken through line 3-3 of FIG. 1.

The structure of one example of previously known side tracks 40 is illustrated in FIG. 3, which is a horizontal cross-section taken through line 3-3 in FIG. 1 to show the right side track 40 and a corresponding portion of the shutter curtain 30. The left side track 40 has a similar configuration. The side track 40 has a pair of side walls 70, 72, and an end wall 74 defining a U-shaped channel. The side track 40 further includes a first pair of fins 76, 78 that extend inwardly from the side walls 70, 72, respectively, and define a first gap 80 that is wide enough to receive the end retention members 50 extending from the ends of the slats 32 and engage bodies 82 and heads 84 of the end retention members 50 to retain the rolling shutter curtain 30 in a manner described more fully in the Miller '224 patent and the Miller '225 patent. An inner wall 86 extends from the side wall 70 to the side wall 72 and is disposed between the end wall 74 and the fins 76, 78.

Configured in this way, the side tracks 40 provide multiple channels. The fins 76, 78 and portions of the side walls 70, 72 define a first channel adapted to receive the slats 32, 46 when the rolling shutter curtain 30 is unrolled. The fins 76, 78, the inner wall 86 and corresponding portions of the side walls 70, 72 extending there between define a second channel adapted to receive the end retention members 50 as illustrated and described in the Miller '224 patent and the Miller '225 patent. Finally, the end wall 74, the inner wall 86 and the remainder of the side walls 70, 72 define a third channel that receives a nipple 88 extending downward from the corresponding end cap 14 when the end cap 14 is attached to the side track 40. Additional fins 90, 92 extending inward from the end wall 74 and the inner wall 86, respectively, engage the nipple 88 to prevent movement within the third channel.

Figure 5:
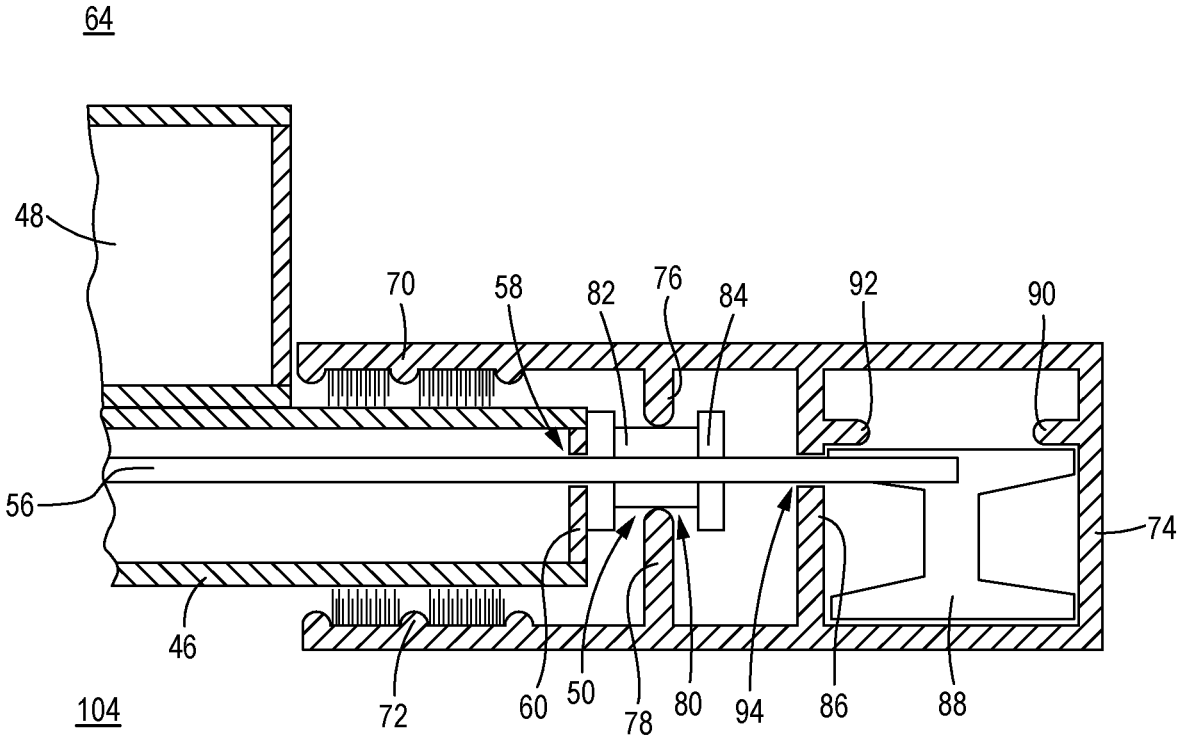
FIG. 5 is a cross-sectional bottom view of a portion of the rolling shutter assembly of FIG. 1 taken through line 5-5 of FIG. 4.
Figure 4:
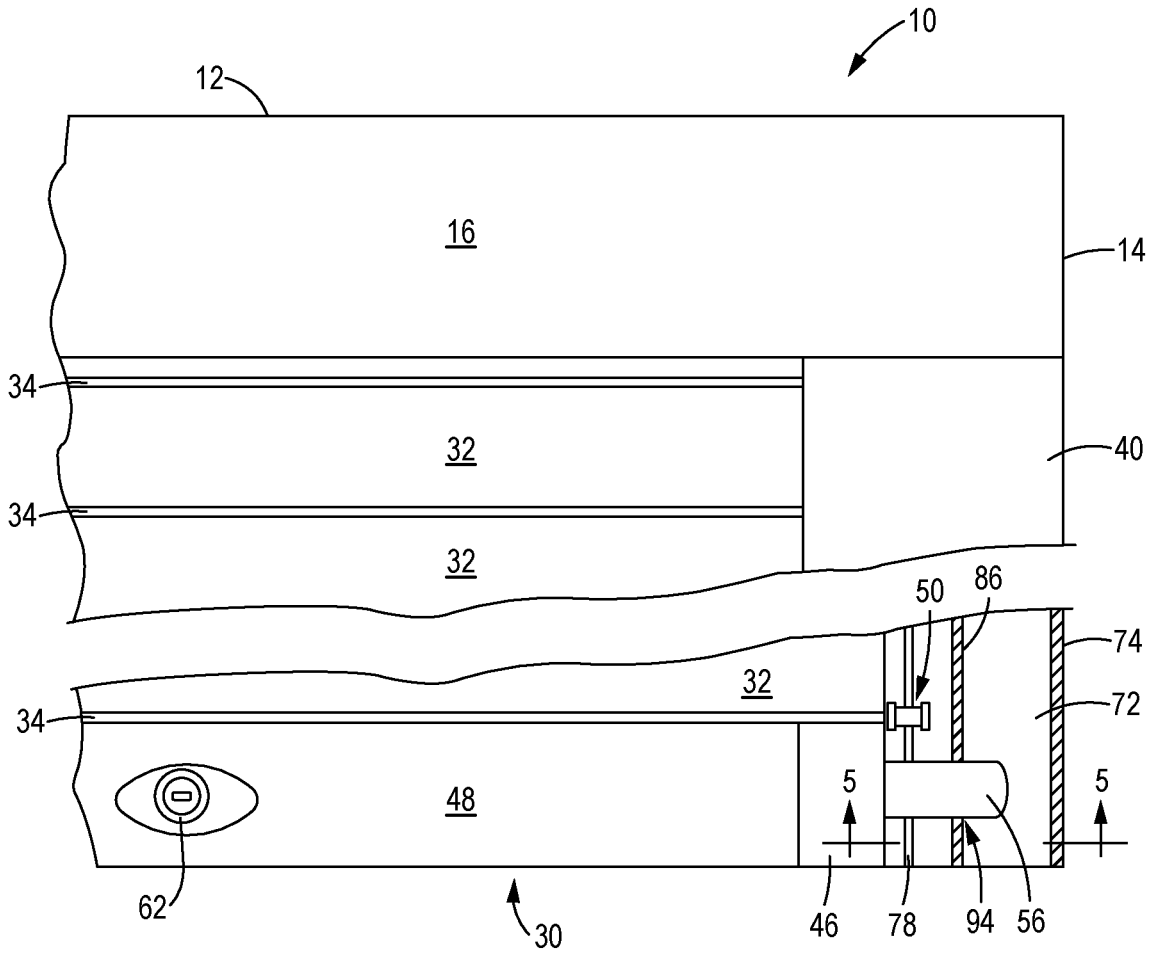
FIG. 4 is a partial cross-sectional front view of the rolling shutter assembly of FIG. 1 with the shutter curtain in an unrolled and locked position.

The side tracks 40 are further configured to facilitate locking of the rolling shutter assembly 10 when the shutter curtain 30 is unrolled to cover the opening. FIGS. 4 and 5 illustrate the rolling shutter assembly 10 with the shutter curtain 30 in the unrolled and locked position. FIG. 4 is a front view in which the right side track 40 is shown in cross-section, and FIG. 5 is a cross-sectional view taken through line 5-5 of FIG. 4. The shutter curtain 30 is unrolled to cover the opening with the base slat 46 disposed proximate the bottoms of the opening and the side tracks 40. Each side track 40 includes a lock arm receiving slot 94 in the inner wall 86 proximate the bottom of the side track 40. The lock arm receiving slot 94 is adapted to receive the end of the corresponding lock arm 56 when the key lock 62 is turned to the locked position as shown in FIG. 4. When the shutter curtain 30 is unrolled and the key lock 62 is locked, the inner wall 86 engages the lock arm 56 to prevent the base slat 46 from being lifted from the bottom of the opening and shutter curtain 30 from being raised or rolled up.

The arrangement of the rolling shutter assembly 10 is effective for preventing entry through the opening covered by the rolling shutter assembly 10 when the shutter curtain 30 is in the unrolled and locked position. However, incidents have occurred where pry bars or other leverage devices have been used to gain leverage and force the base slat 46 upward to gain access through the opening under the base slat 46. To prevent prying up of the base slat 46, a base slat pry stopper in accordance with the present disclosure may be installed with the rolling shutter assembly 10. For example, FIGS. 6 and 7 illustrate a base slat pry stopper in the form of a base slat locking bracket 100 that is mounted to or on an opening bottom wall 102 defining the opening of the structure being protected by the rolling shutter assembly 10.

Figure 6:
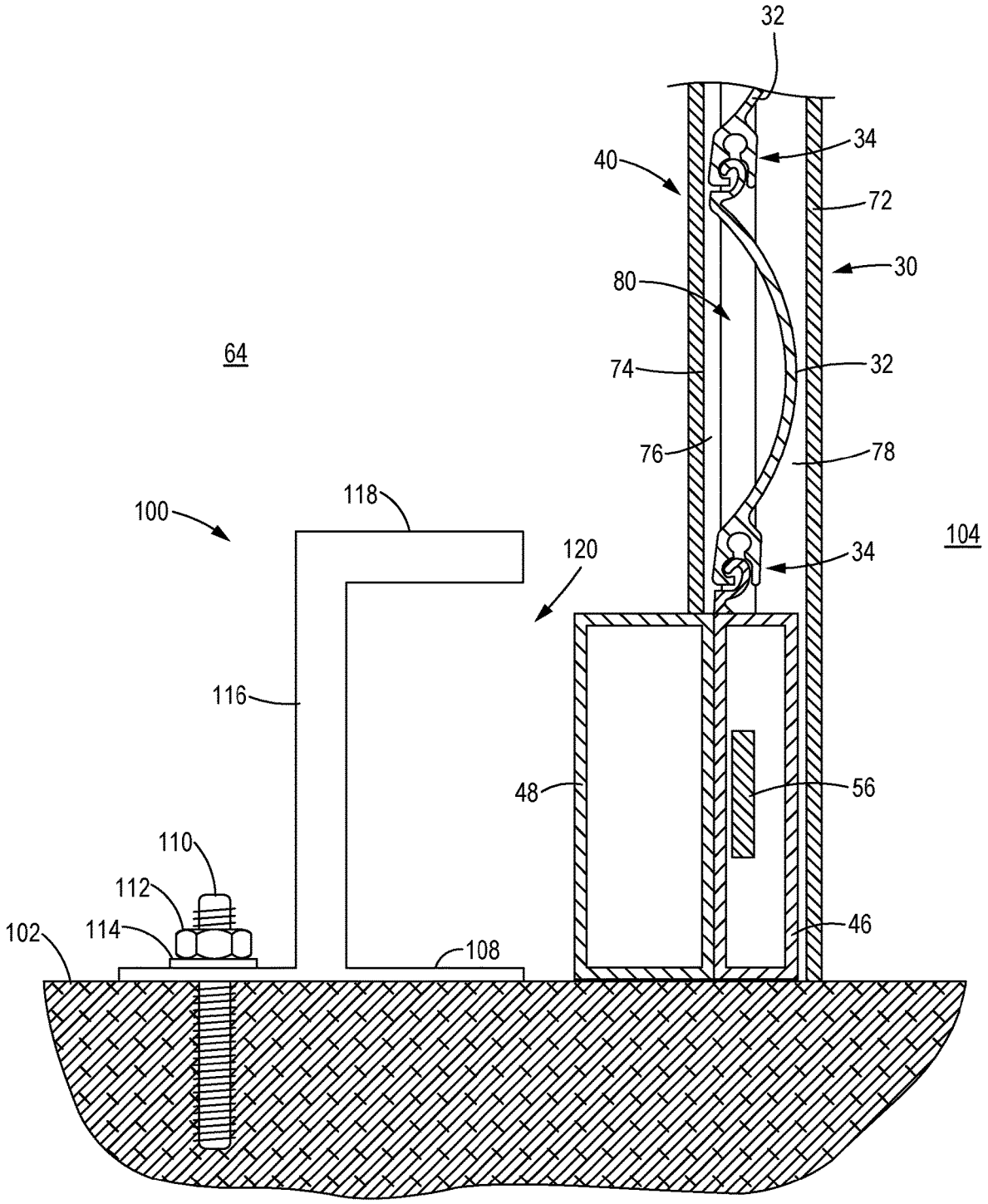
FIG. 6 is a cross-sectional view of a bottom portion of the shutter curtain of the rolling shutter assembly of FIG. 1 in the unrolled and locked position and a side view of a base slat pry stopper in accordance with the present disclosure mounted to an opening bottom wall.
Figure 7:
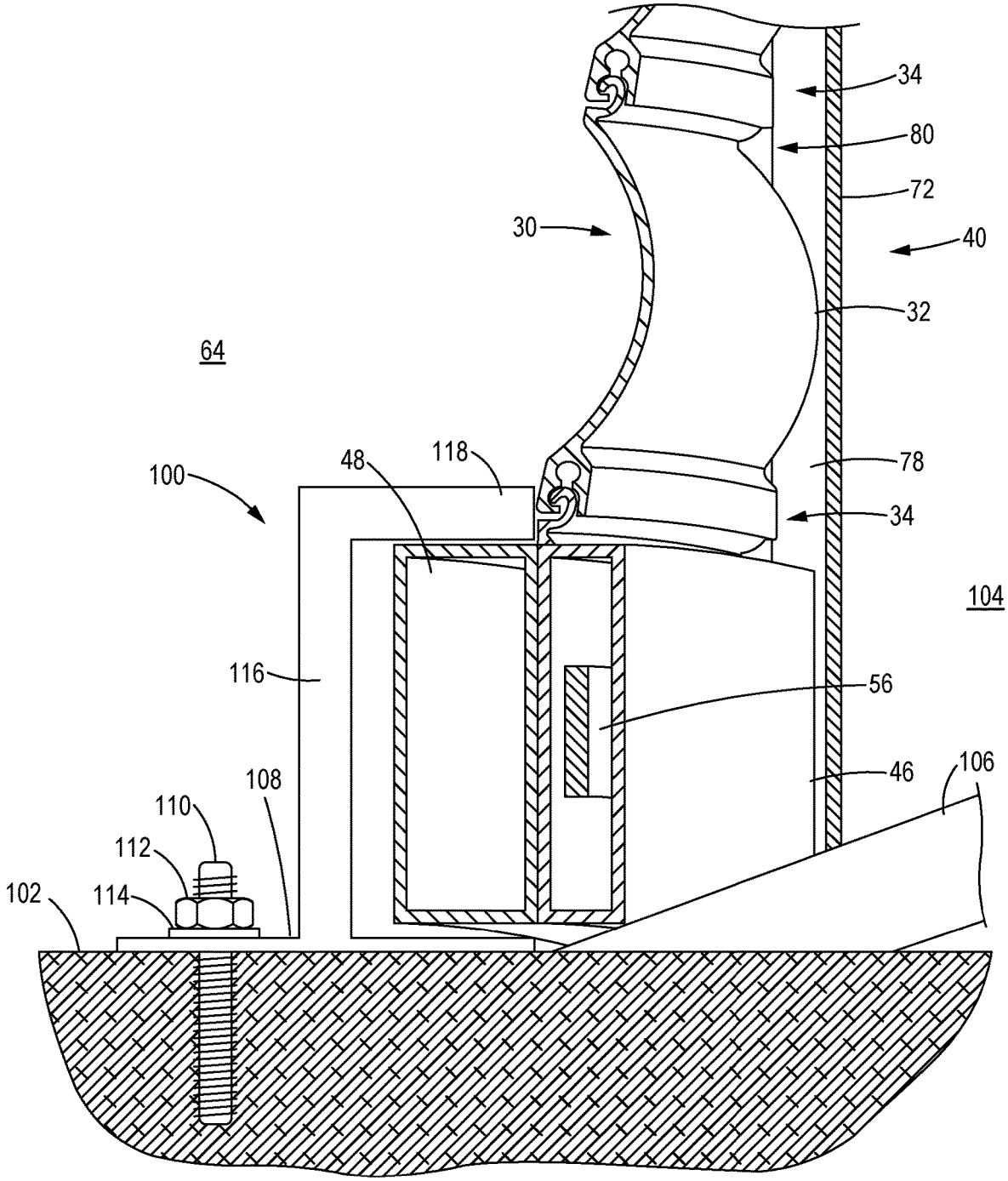
FIG. 7 is the bottom portion of the shutter curtain and the base slat pry stopper of FIG. 6 with a pry bar forcing the base slat of the shutter curtain into engagement with the base slat pry stopper.

Referring to FIG. 6, the base slat locking bracket 100 is mounted to the opening bottom wall 102 on the interior side 64 of the rolling shutter assembly 10 and the protected structure. The base slat locking bracket 100 is positioned so that the base slat 46 and the base slat body 48 can move upward and downward past the base slat locking bracket 100 when the shutter curtain 30 is rolled onto and unrolled from the shutter support member 20. FIG. 6 shows the shutter curtain 30 in the unrolled position, and the lock arms 56 are extended into the lock arm receiving slots 94 of the side tracks 40 to lock the base slat 46 at the opening bottom wall 102. When a force applied to the base slat 46 from an exterior side 104 of the shutter curtain 30 and the structure, such as by a pry bar 106 forced under the base slat 46 as shown in FIG. 7, the base slat 46 deflects toward the interior side 64 of the structure and the shutter curtain 30 and into engagement with the base slat locking bracket 100 to prevent the base slat 46 from deflecting further inward into the interior side 64 of the opening and upward away from the opening bottom wall 102.

Referring back to FIG. 6, the base slat locking bracket 100 in the illustrated embodiment includes a bracket base plate 108 mounted to the opening bottom wall 102 by one or more bolts 110 embedded in the opening bottom wall 102 and extending through corresponding bolt holes (not shown) in the bracket base plate 108. Nuts 112 and washers 114 may be installed and tightened down so that the base slat locking bracket 100 can remain in place for a desired period of time, and removed and/or replaced if necessary. The base slat locking bracket 100 further includes base slat engagement portion in the form of a bracket back wall 116 extending upward from the bracket base plate 108 and the opening bottom wall 102, and a bracket top wall 118 extending from the bracket back wall 116 above the opening bottom wall 102 and toward the exterior side 104 of the shutter curtain 30 and the structure. The bracket top wall 118 and the opening bottom wall 102 define a base slat opening 120 of the base slat engagement portion receiving the base slat 46, and in particular the base slat body 48, when the base slat 46 is deflected toward the interior side 64 of the shutter curtain 30 and the structure by the pry bar 106 as shown in FIG. 7.

Figure 8:
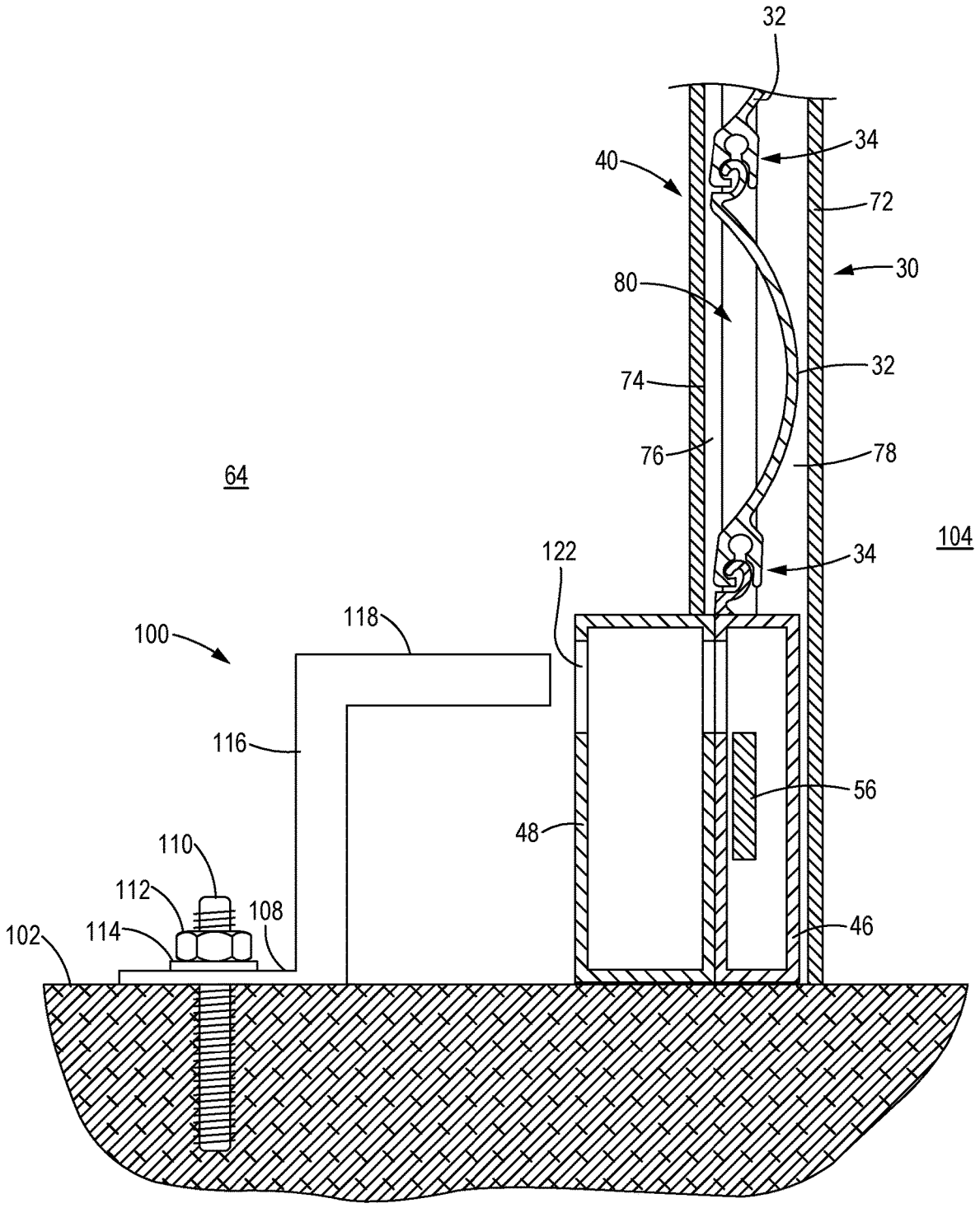
FIG. 8 is a cross-sectional view of the bottom portion of the shutter curtain of the rolling shutter assembly of FIG. 1 in the unrolled and locked position and a side view of an alternative embodiment of a base slat pry stopper in accordance with the present disclosure mounted to the opening bottom wall.
Figure 9:
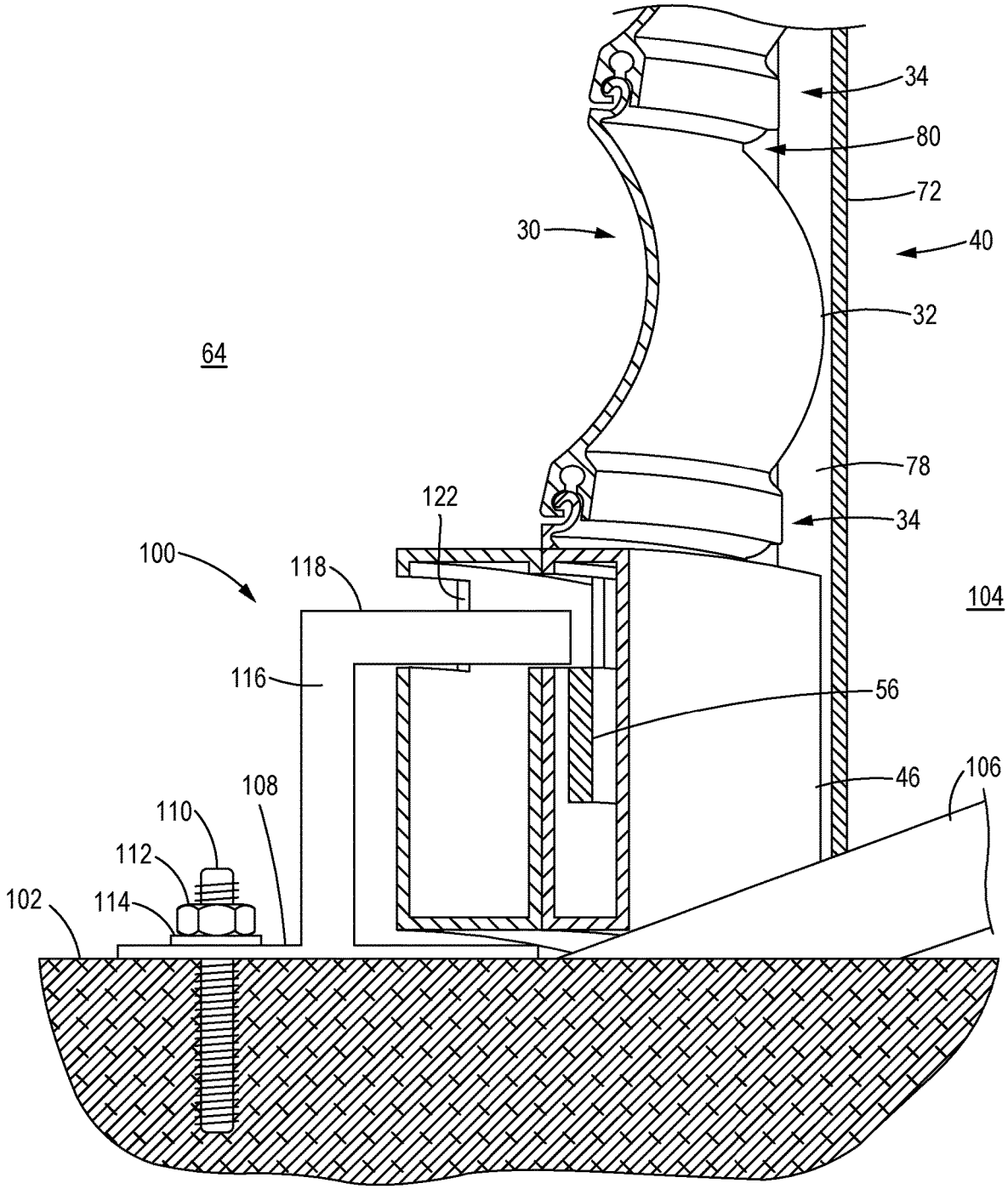
FIG. 9 is the bottom portion of the shutter curtain and the base slat pry stopper of FIG. 8 with a pry bar forcing the base slat of the shutter curtain into engagement with the base slat pry stopper.

FIGS. 8 and 9 illustrate an alternative embodiment of the base slat 46 and the base slat locking bracket 100 where the base slat 46 is configured to receive and engage the bracket top wall 118 during an attempted breach by prying up the base slat 46. Referring to FIG. 8, in the illustrated embodiment, the base slat 46 includes a bracket top wall opening 122 on the interior side 64 of the base slat 46 and the base slat body 48. The bracket top wall opening 122 may extend upward above the lock arm 56. The base slat engagement portion of the base slat locking bracket 100 is modified in this embodiment to shorten the bracket back wall 116 and correspondingly lower the bracket top wall 118 to align with the bracket top wall opening 122 of the base slat 46. When the force applied to the base slat 46 from an exterior side 104 of the shutter curtain 30 by the pry bar 106 as shown in FIG. 9, the base slat 46 deflects toward the base slat locking bracket 100 and a portion of the base slat 46 is received by the base slat opening 120. At the same time, the bracket top wall 118 enters the bracket top wall opening 122 and is engaged by the walls of the base slat 46 and the base slat body 48 to prevent the base slat 46 from deflecting further inward into the interior side 64 of the opening and upward away from the opening bottom wall 102. The base slat 46 and the base slat locking bracket 100 can be dimensioned so that the bracket top wall 118 will extend over and engage the lock arm 56 when the base slat 46 is deflected inward by the pry bar 106 by a sufficient distance. The engagement of the lock arm 56 may provide additional support against lifting of the base slat 46 by the pry bar 106.

FIGS. 7 and 9 illustrate the inward and upward deflection of the central portion of the base slat 46, the base slat body 48 and the bottommost slats 32 due to the force applied by the pry bar 106. However, the ends of the base slat 46 and the bottommost slats 32 are prevented from displacing upward away from the opening bottom wall 102 and being pulled inward due to the engagement of the ends by the side tracks 40. The lock arms 56 within the lock arm receiving slots 94 are engaged by the inner walls 86 to resist upward movement. At the same time, the fins 76, 78 engage the end retention members 50 to prevent the ends of the slats 32, 46 from being pulled out of the side tracks 40. The base slat locking bracket 100 effectively reduces the distance between each side track 40 and the next point of anchoring of the base slat 46 at the opening bottom wall 102. The relatively narrow portion of the base slat 46 between the side track 40 and the base slat locking bracket 100 will be more resistant to upward deflection than the full span of the base slat 46 from side track 40 to side track 40, which is particularly advantageous in applications where the rolling shutter assemblies 10 cover wide openings, such as installations where a single rolling shutter assembly 10 covers a main entrance to a store or facility having multiple entry and exit doors that are side-by-side.

The embodiments of the base slat locking bracket 100 are exemplary of base slat pry stoppers in accordance with the present disclosure, and diverse alternative embodiments are contemplated. For example, the base slat engagement portion of the base slat locking bracket 100 may have alternative shapes that both allow the shutter curtain 30 to move upward and downward past the base slat locking bracket 100 under normal conditions, and engage the base slat 46 when a force is applied proximate the base slat 46 from the exterior side 104. For example, the combination of the bracket back wall 116 and the bracket top wall 118 in the base slat engagement portion may be rounded as opposed to planar as shown to have a shape more approximating a hook when viewed from the side. Alternatively, the bracket top wall 118 could be angled downward from the bracket back wall 116 toward the base slat 46 and the opening bottom wall 102. Other alternative configurations providing clearance under normal conditions and engagement when a breach of the shutter curtain 30 is attempted will be apparent to those skilled in the art based on applicant's disclosure.

As further shown in the embodiments of FIGS. 6-9, the base slat locking bracket 100 is installed on a top surface of the opening bottom wall 102. In the embodiment of FIGS. 6-7, the bracket base plate 108 creates a lip at the base slat opening 120 such that the base slat 46 and the base slat body 48 must be elevated above the opening bottom wall 102 by a distance at least greater than the thickness of the bracket base plate 108 before the base slat body 48 can enter the base slat opening 120. In the alternative embodiment of FIGS. 8-9, the bracket base plate 108 and the bracket top wall 118 are dimensioned so that the bracket top wall 118 extends beyond the bracket base plate 108 toward the shutter curtain 30. With this configuration, the bracket top wall 118 can enter the bracket top wall opening 122 even if the base slat 46 is skidding along the opening bottom wall 102. In further alternative embodiments, the opening bottom wall 102 may have a base plate recess 130 (FIGS. 12-14) defined therein into which the bracket base plate 108 is installed below the top surface of the opening bottom wall 102. The base plate recess 130 may have a depth that is at least as great as the thickness of the bracket base plate 108 so that the top surface of the bracket base plate 108 is at or below the top surface of the opening bottom wall 102. With the bracket base plate 108 recessed, the lip is eliminated and the base slat 46 can slide along the opening bottom wall 102 and into the base slat opening 120 (FIG. 7) or receive the bracket top wall 118 (FIG. 9) without the potential for obstruction.

Figure 10:
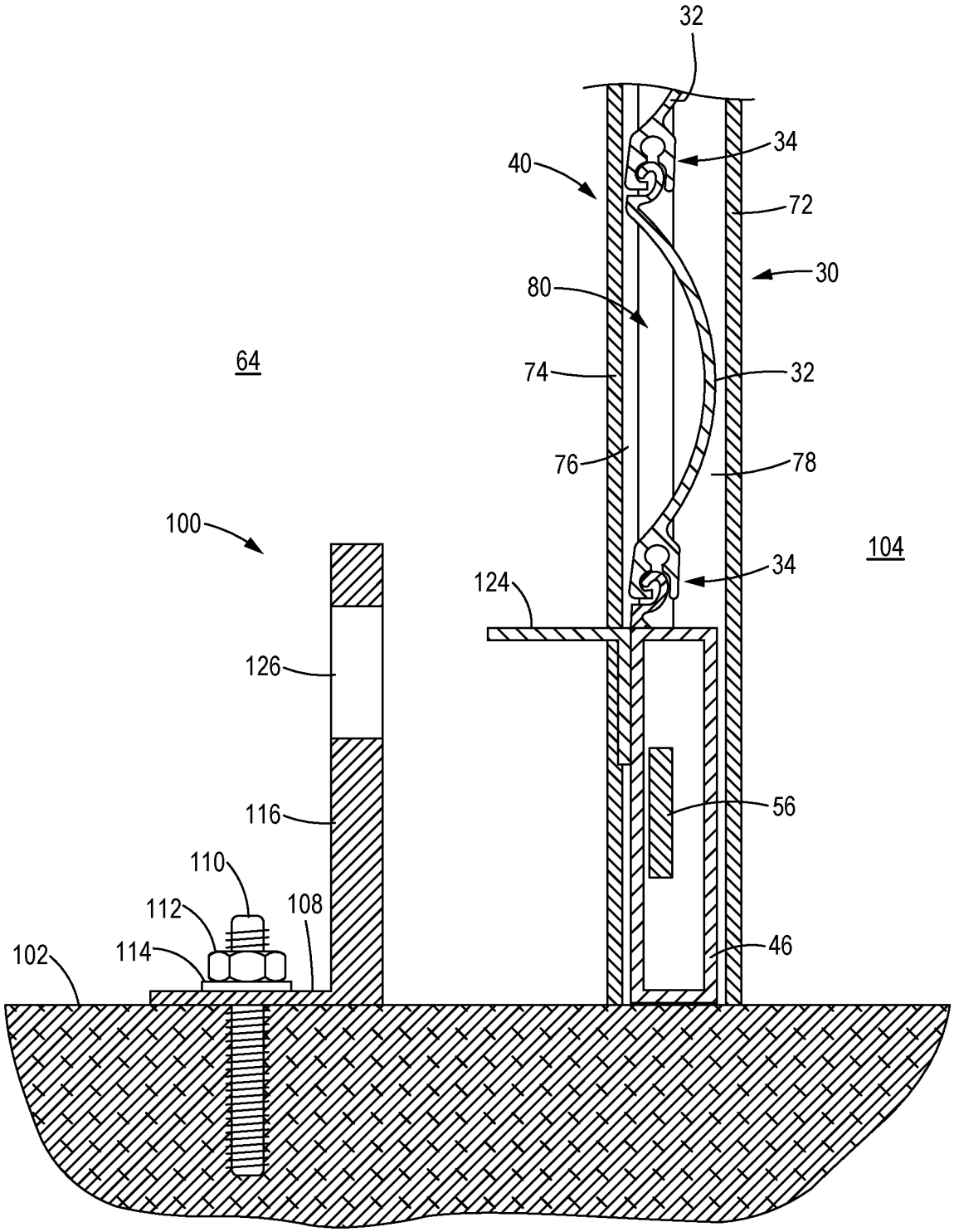
FIG. 10 is a cross-sectional view of the bottom portion of the shutter curtain of the rolling shutter assembly of FIG. 1 in the unrolled and locked position and a side view of another alternative embodiment of a base slat pry stopper in accordance with the present disclosure mounted to the opening bottom wall.
Figure 11:
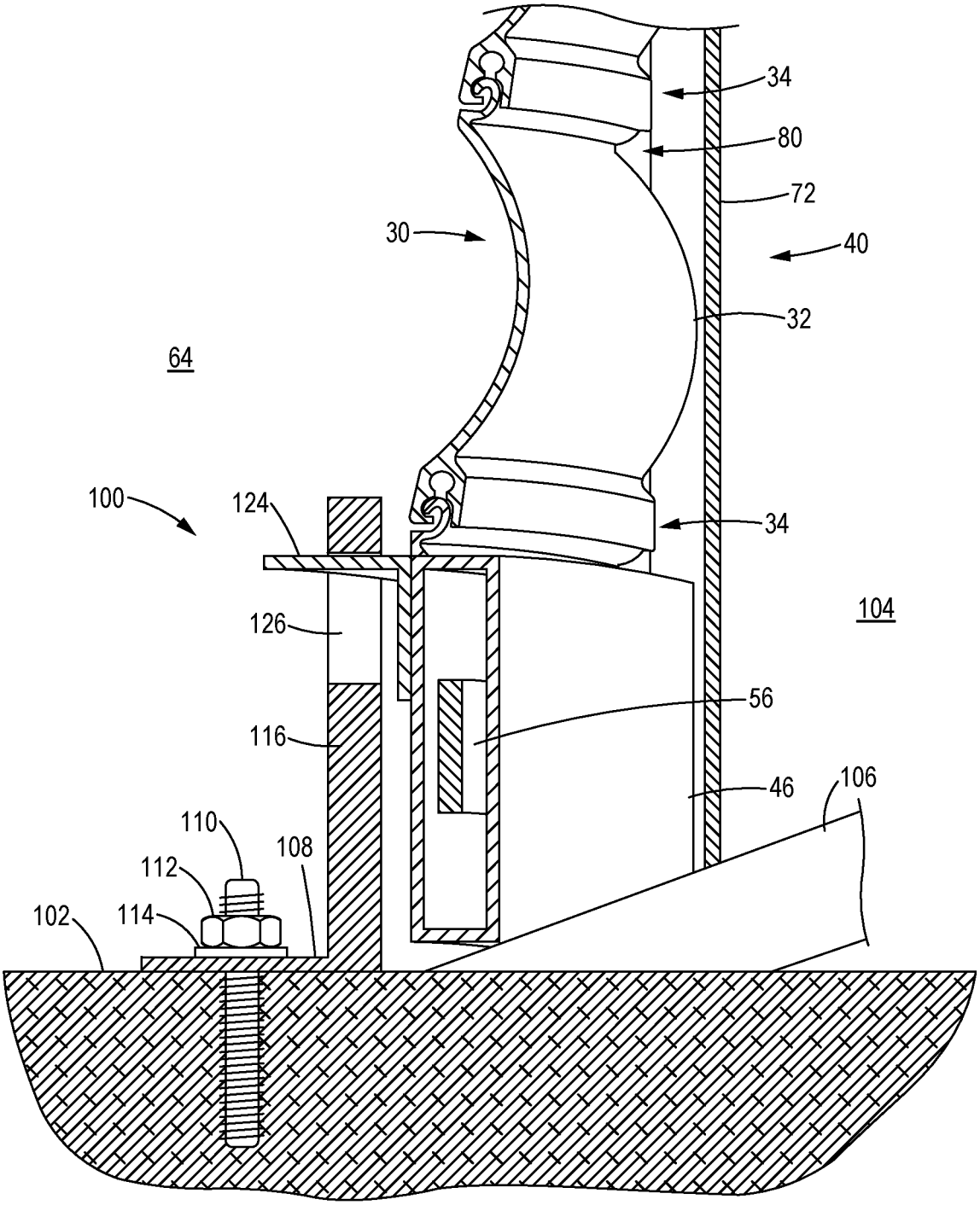
FIG. 11 is the bottom portion of the shutter curtain and the base slat pry stopper of FIG. 10 with a pry bar forcing the base slat of the shutter curtain into engagement with the base slat pry stopper.

FIGS. 10 and 11 illustrate a further alternative embodiment of the base slat 46 and the base slat locking bracket 100 where the bracket back wall 116 is configured to engage a portion of the base slat 46. Referring to FIG. 10, the base slat 46 may omit the base slat body 48, and may instead have a base slat handle or pry stop arm 124 mounted thereto and extending toward the interior side 64 of the shutter curtain 30. The base slat locking bracket 100 is modified to omit the bracket top wall 118 from the base slat engagement portion, and to provide a bracket back wall opening 126 in the bracket back wall 116. The bracket back wall opening 126 may extend upward above the handle or pry stop arm 124 when the shutter curtain 30 is unrolled and the base slat 46 is disposed at the top surface of the opening bottom wall 102. When the force applied to the base slat 46 from the exterior side 104 of the shutter curtain 30 by the pry bar 106 as shown in FIG. 11, the base slat 46 deflects toward the base slat locking bracket 100 and a portion of the pry stop arm 126 is received by the bracket back wall opening 126 and is engaged by the base slat locking bracket 100 to prevent the base slat 46 from deflecting further inward into the interior side 64 of the opening and upward away from the opening bottom wall 102.

In the embodiments of FIGS. 6-11, the base slat locking bracket 100 is permanently or semi-permanently mounted to the opening bottom wall 102. Even when the base slat locking bracket 100 is removed, the bolts 110 may extend upward from the opening bottom wall 102. When the rolling shutter assembly 10 is used to cover an opening that is used for ingress into and egress from a building, the opening cannot have obstructions that can cause a trip hazard or other impediment to safe ingress and egress when the shutter curtain 30 is rolled up. In some implementations, the base slat locking bracket 100 can be installed in an area that is protected from foot traffic, such as on an interior side of a door jamb or safety rail disposed within the opening. Other implementations may not allow for installation of the base slat locking bracket 100 in the opening without creating an ingress and egress hazard. To accommodate such implementations, the base slat locking bracket 100 may be configured to be removable or retractable to allow obstruction-free ingress and egress through the opening when appropriate.

Figure 12:
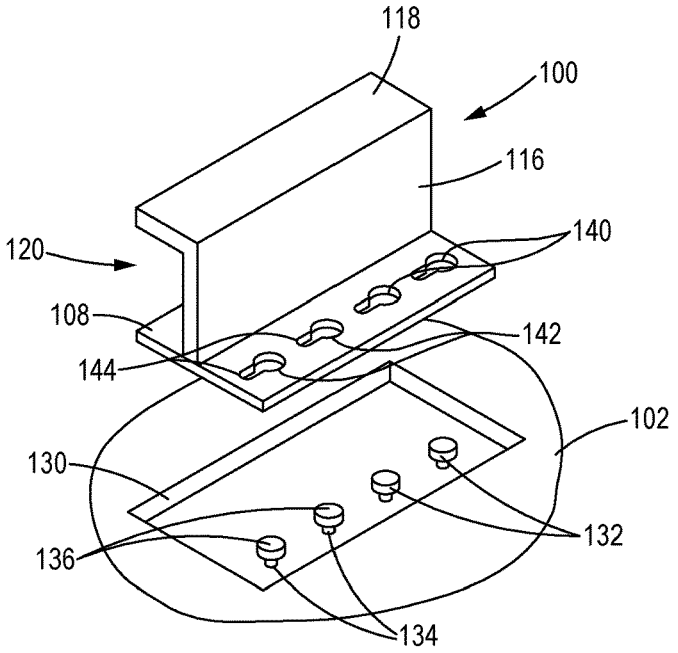
FIG. 12 is an isometric view of the base slat pry stopper of FIG. 6 and a portion of an opening bottom wall having a base plate recess with bracket retention members in accordance with the present disclosure.
Figure 13:
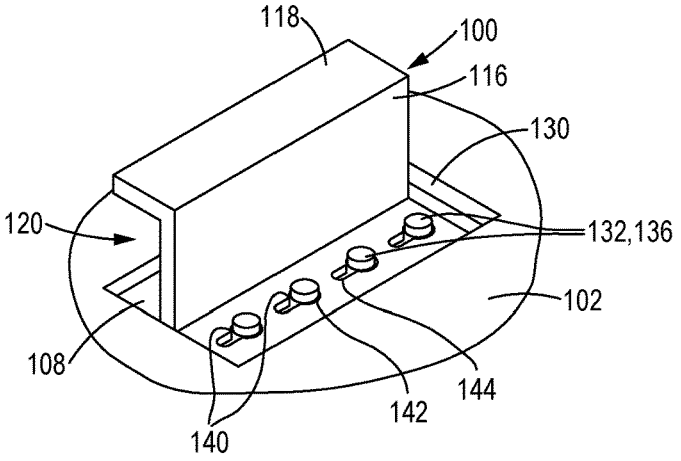
FIG. 13 is the isometric view of FIG. 12 with the base slat pry stopper lowered into the base plate recess.
Figure 14:
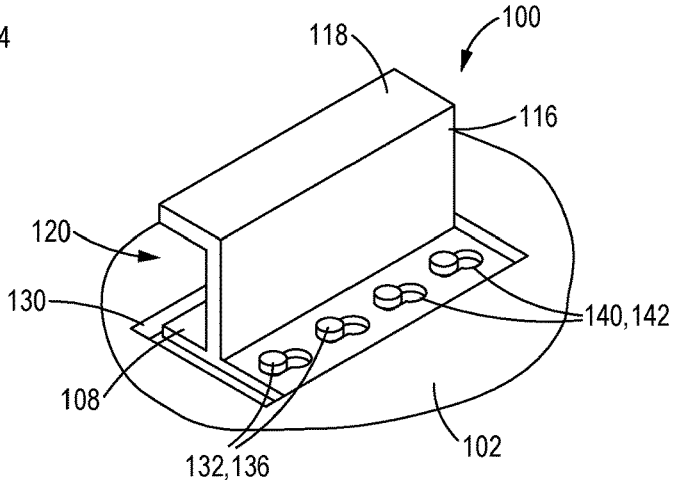
FIG. 14 is the isometric view of FIG. 12 with the base slat pry stopper moved to a locked position within the base plate recess.

FIGS. 12-14 illustrate an embodiment of the base slat locking bracket 100 that is selectively removable to avoid being an obstruction when the shutter curtain 30 is open during normal use or during emergency situations. As discussed above, the opening bottom wall 102 may include a base plate recess 130 defined therein that is configured to receive the bracket base plate 108. The base plate recess 130 may have a plurality of bracket retention members 132 anchored in the opening bottom wall 102 therein and extending upward therefrom. Each bracket retention member 132 may have a retention shank 134 anchored in the opening bottom wall 102, and a retention head 136 on the retention shank 134 and disposed above the opening bottom wall 102. The retention shanks 134 have a shank width, and the retention heads 136 have a head width that is greater than the shank width. As shown, the bracket retention members 132 are arranged in a row, but may be arranged in other configurations as necessary to engage and retain the base slat locking bracket 100 as discussed below.

The base slat locking bracket 100 is modified to be engaged by the bracket retention members 132 when the bracket base plate 108 is inserted into the base plate recess 130. The bracket base plate 108 includes a plurality of bracket retention slots 140 extending there through, and with each aligning with a corresponding one of the bracket retention members 132. Each of the bracket retention slots 140 includes a receiving section 142 having a receiving section width that is greater than the head width, and a locking section 144 having a locking section width that is less than the head width and greater than the shank width of the bracket retention members 132. The retention shanks 134 will have a shank length from the surface of the opening bottom wall 102 to the bottoms of the retention heads 136 that is greater than the thickness of the bracket base plate 108.

The base slat locking bracket 100 is removably mounted to the opening bottom wall 102 by lowering the bracket base plate 108 into the base plate recess 130 with the receiving sections 142 of the bracket retention slots 140 aligned with the retention heads 136 of the corresponding bracket retention members 132. The retention heads 136 pass through the receiving sections 142 and are disposed above the bracket base plate 108 when the bracket base plate 108 comes to rest on the opening bottom wall 102 within the base plate recess 130 as shown in FIG. 11. The base plate recess 130 is configured wide enough for the base slat locking bracket 100 to slide parallel along the opening bottom wall 102 to dispose the retention shanks 134 within the locking sections 144 of the bracket retention slots 140 when the base slat locking bracket 100 is in the locked position shown in FIG. 12. In this position, the retention heads 136 engage the bracket base plate 108 to prevent the base slat locking bracket 100 from moving upward from the opening bottom wall 102 when a break in is attempted and the base slat 46 is received through the base slat opening 120. If desired, the base slat locking bracket 100 and/or the base plate recess 130 can include a locking mechanism that can be engaged to retain the base slat locking bracket 100 in the locked position shown in FIG. 14. When the rolling shutter assembly 10 is opened to permit traffic through the opening, the base slat locking bracket 100 is removed by sliding back in the opposite direction until the retention heads 136 and the receiving sections 142 are aligned and the base slat locking bracket 100 can be lifted out of the base plate recess 130.

For the reasons discussed above for making the base slat locking bracket 100 removable, the base plate recess 130 and the bracket retention members 132 may be configured to avoid being an obstruction or tripping hazard when the shutter curtain 30 is open and the base slat locking bracket 100 is removed. Consequently, the base plate recess 130 may be deep enough so that the retention heads 136 of the bracket retention members 132 anchored within the base plate recess 130 are at or below the level of the top surface of the opening bottom wall 102 outside of the base plate recess 130. In this way, the bracket retention members 132 do not extend into the opening. The base plate recess 130 may further include a cover (not shown) that may be placed over the base plate recess 130 when the base slat locking bracket 100 is removed so that the opening bottom wall 102 has a smooth, continuous surface. The cover can be separate from the base plate recess 130, or may be secured to the opening bottom wall by a hinge or other connection mechanism allowing the cover to move between an open position where the base plate recess 130 is exposed and the base slat locking bracket 100 can be installed, and a closed position covering the base plate recess 130.

Figure 15:
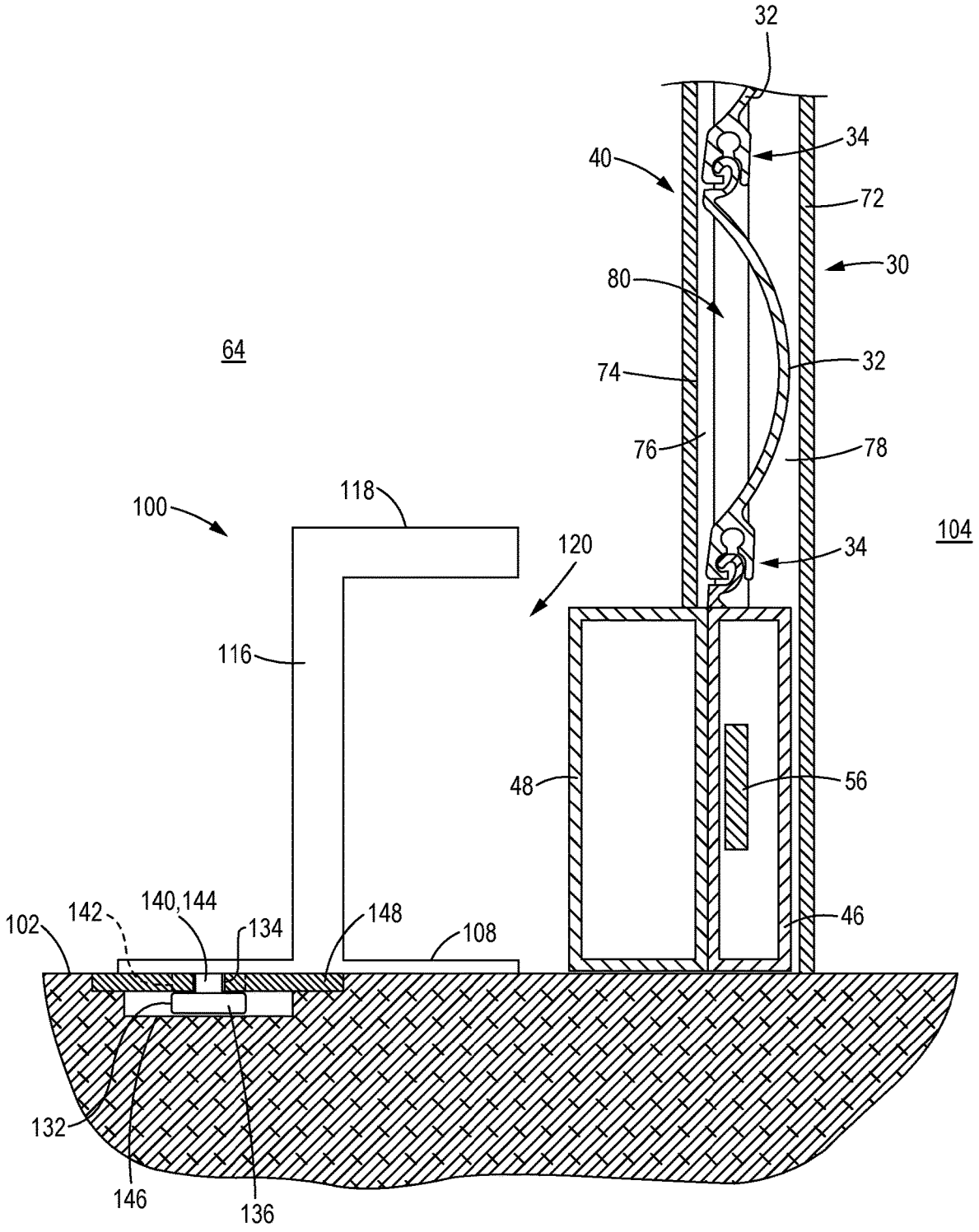
FIG. 15 is a cross-sectional view of the bottom portion of the shutter curtain of the rolling shutter assembly of FIG. 1 in the unrolled and locked position and a side view of an alternative embodiment of a base slat pry stopper with bracket retention members in accordance with the present disclosure mounted to the opening bottom wall.

FIG. 15 illustrates an alternative embodiment with the locations of the bracket retention members 132 and the bracket retention slots 140 reversed to avoid creating an obstruction in the opening when the base slat locking bracket 100 is removed. In this embodiment, the bracket retention members 132 are mounted to and extend downward from the bracket base plate 108. The opening bottom wall 102 has a base plate recess 146 defined therein into which a bracket retention plate 148 is installed to provide a continuous top surface for the opening bottom wall 102. The bracket retention plate 148 may be secured within the base plate recess 146 using fasteners, adhesive or any other appropriate attachment mechanism that will retain the bracket retention plate 148 within the base plate recess 146 when an attempt is made to pry up the base plate 46.

The bracket retention plate 148 may have a plurality of the bracket retention slots 140 defined therein, with each having receiving sections 142 and locking sections 144 as described above and being arranged to align with the bracket retention members 132 on the bracket base plate 108. The base plate recess 146 may have a depth that is at least as great as the length of the bracket retention members 132 extending downward from the bracket base plate 108 so that the bracket base plate 108 rests on the top surfaces of the bracket retention plate 148 and/or the opening bottom wall 102 when the bracket retention members 132 are inserted. The bracket retention plate 148 may have a thickness that is less than the shank length from the bottom surface of the bracket base plate 108 to the retention heads 136 so that the retention shanks 134 can slide into the locking sections 144 of the bracket retention slots 140 and secure the base slat locking bracket 100 to the opening bottom wall 102. When the base slat locking bracket 100 is removed from the bracket retention plate 148, the opening will be free of obstruction due to the continuous surface provided by the bracket retention plate 148 and the top surface of the opening bottom wall 102.

The configuration of the base slat locking bracket 100 and the base plate recesses 130, 146 facilitating installation and removal of the base slat locking brackets 100 as shown in FIGS. 12-15 are exemplary. Alternative mechanisms for removably connecting a base slat pry stopper to the opening bottom wall are contemplated. Such alternatives include alternate selectively engageable mechanical attachment mechanisms known in the art. Further, attachment mechanisms incorporating electro-mechanical, hydro-mechanical and pneumatic actuators may be implemented. In such attachment mechanisms, input devices may be provided to selectively operate the actuators to facilitate engagement and disengagement of the base slat locking bracket 100. Implementation of such alternative removable attachment mechanisms will be within the capability of those skilled in the art, and are contemplated by the applicant.

Figure 16:
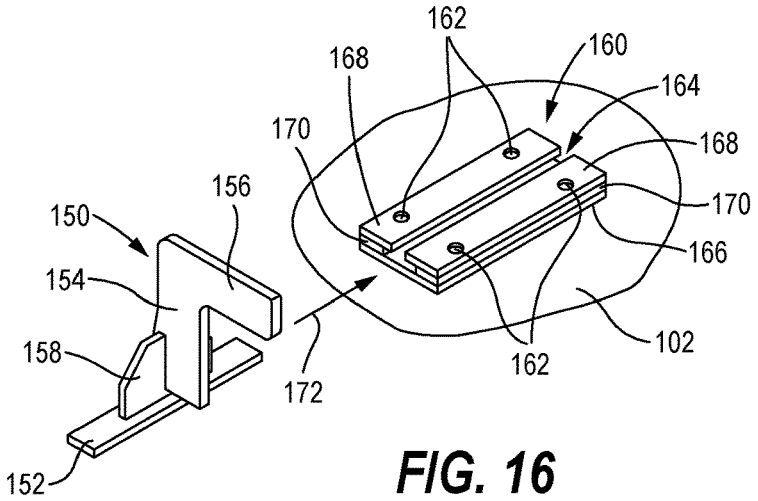
FIG. 16 is an isometric view of a further alternative embodiment of a base slat pry stopper and a portion of the opening bottom wall having a base plate slide mount in accordance with the present disclosure.
Figure 17:
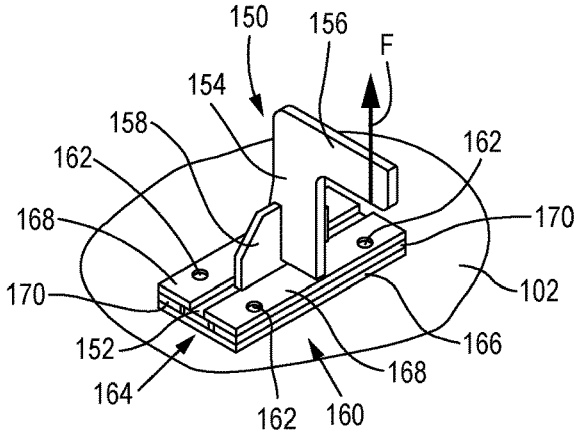
FIG. 17 is the isometric view of FIG. 16 with the bracket base plate of the base slat pry stopper received by the base plate slide mount.

FIGS. 16 and 17 illustrate one alternative mechanism for removably mounting a base slat pry stopper to the opening bottom wall 102. Referring to FIG. 16, the base slat pry stopper is illustrated in the form of a base slat locking bracket 150 having a bracket base plate 152 and a base slat engagement portion in the form of a bracket back wall 154 extending upward from the bracket base plate, and a bracket top wall 156 extending outward from the bracket back wall 154. A bracket gusset or gussets 158 may connect the bracket back wall 154 to the bracket base plate 152 with the bracket back wall 154 being raised above the bracket base plate 152 to facilitate installation of the base slat locking bracket 150 as discussed further below. The bracket back wall 154 and the bracket top wall 156 may be configured for the bracket top wall 156 to receive and engage the base slat 46 as shown in FIG. 7, to be received by the bracket top wall opening 122 as shown in FIG. 9, or to otherwise engage the base slat 46 when the base slat 46 is deflected toward the interior side 64 of the shutter curtain 30.

The illustrated embodiment further includes a base plate slide mount 160 that is anchored to the opening bottom wall 102 by fasteners 162 or other appropriate attachment mechanism. The base plate slide mount 160 as shown has a multi-piece construction forming a bracket retention slot 164 into which the bracket base plate 152 will be inserted. The base plate slide mount 160 includes a slide mount base plate 166 disposed on the top surface of the opening bottom wall 102, a pair of bracket retention plates 168 dispose opposite the slide mount base plate 166, and a pair of slide mount spacer plates 170 disposed between the slide mount base plate 166 and the bracket retention plates 168. The bracket retention plates 168 are spaced apart by a distance that is greater than a thickness of the bracket gusset 158 but less than a width of the bracket base plate 152, and have a thickness that is less than a distance between the top of the bracket base plate 152 and the bottom of the bracket back wall 154. The slide mount spacer plates 170 are spaced apart by a distance that is greater than the bracket base plate 152 and have a thickness that is greater than a thickness of the bracket base plate 152. In alternative embodiments, the slide mount base plate 166, the bracket retention plates 168 and the slide mount spacer plates 170 may be formed as a single unitary component defining the bracket retention slot 164 as described herein and mounted to the opening bottom wall 102.

The spacing and dimensions of the bracket retention plates 168 and the slide mount spacer plates 170 define the bracket retention slot 164 so that the bracket base plate 152 can be received therein and engaged to secure the base slat locking bracket 150 against forces that may be transmitted from the base slat 46. The base slat locking bracket 150 is installed by sliding the bracket base plate 152 into the bracket retention slot 164 as indicated by the arrow 172 in FIG. 16. As shown in FIG. 17, the bracket gusset 158 is received between the bracket retention plates 168 and the bracket base plate 152 is received between the slide mount spacer plates 170 and beneath the bracket retention plates 168. The bracket retention plates 168 partially overlay the bracket base plate 152 to prevent the base slat locking bracket 150 from being pulled upward. The bracket back wall 154 extends over the bracket retention plates 168 and engages the bracket retention plates 168 when the base slat 46 applies an offset load F to the bracket top wall 156 tending to rotate the base slat locking bracket 150 about the bracket base plate 152.

Figure 18:
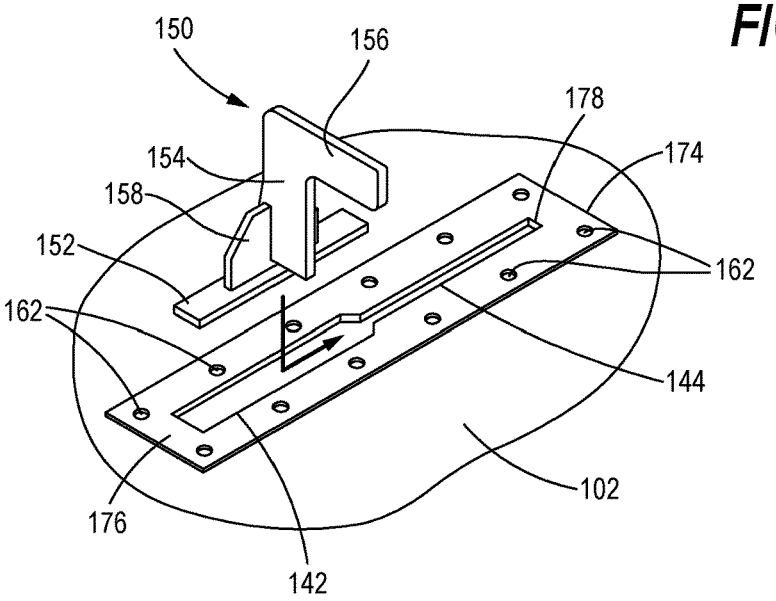
FIG. 18 is an isometric view of another alternative embodiment of the base slat pry stopper of FIG. 16 and a portion of the opening bottom wall having a bracket retention plate in accordance with the present disclosure.

FIG. 18 illustrates an alternative embodiment to the base plate slide mount 160 of FIGS. 16-17 that may be implemented to avoid creating an obstruction in the opening when the base slat locking bracket 150 is removed. In this embodiment, the opening bottom wall 102 has a retention plate recess 174 defined therein into which a bracket retention plate 176 is installed to provide a continuous top surface for the opening bottom wall 102. The bracket retention plate 176 may be secured within the retention plate recess 174 using fasteners 162 or any other appropriate attachment mechanism that will retain the bracket retention plate 176 within the retention plate recess 174 when an attempt is made to pry up the base plate 46.

The bracket retention plate 176 may have a bracket retention slot 178 defined therein having a generally similar configuration as the bracket retention slots 140 described above, including a receiving section 142 and a locking section 144. The receiving section 142 has a width that is greater than the width of the bracket base plate 152 and a longitudinal length that is greater than a longitudinal length of the bracket base plate 152. The locking section 144 has a width that is greater than the thickness of the bracket gusset 158 but less than the width of the bracket base plate 152. The retention plate recess 174 may have a depth that is at least as great as the distance from the bottom of the bracket back wall 154 to the bottom of the bracket base plate 152 so that the bracket back wall 154 rests on the top surfaces of the bracket retention plate 176 and/or the opening bottom wall 102 when the bracket base plate 152 is inserted though the receiving section 142. The bracket retention plate 176 has a thickness that is less than the distance between the top of the bracket base plate 152 and the bottom of the bracket back wall 154 so that the bracket gusset 158 can slide into the locking section 144 and secure the base slat locking bracket 150 to the opening bottom wall 102. The base slat locking bracket 150 is installed by lowering the bracket base plate 152 through the receiving section 142 of the bracket retention slot 178, and then sliding the bracket gusset 158 into the locking section 144 so that the bracket base slat 152 is engaged by the bottom surface of the bracket retention plate 176. When the base slat locking bracket 150 is removed from the bracket retention plate 176, the opening will be free of obstruction due to the continuous surface provided by the bracket retention plate 176 and the top surface of the opening bottom wall 102.

Figure 20:
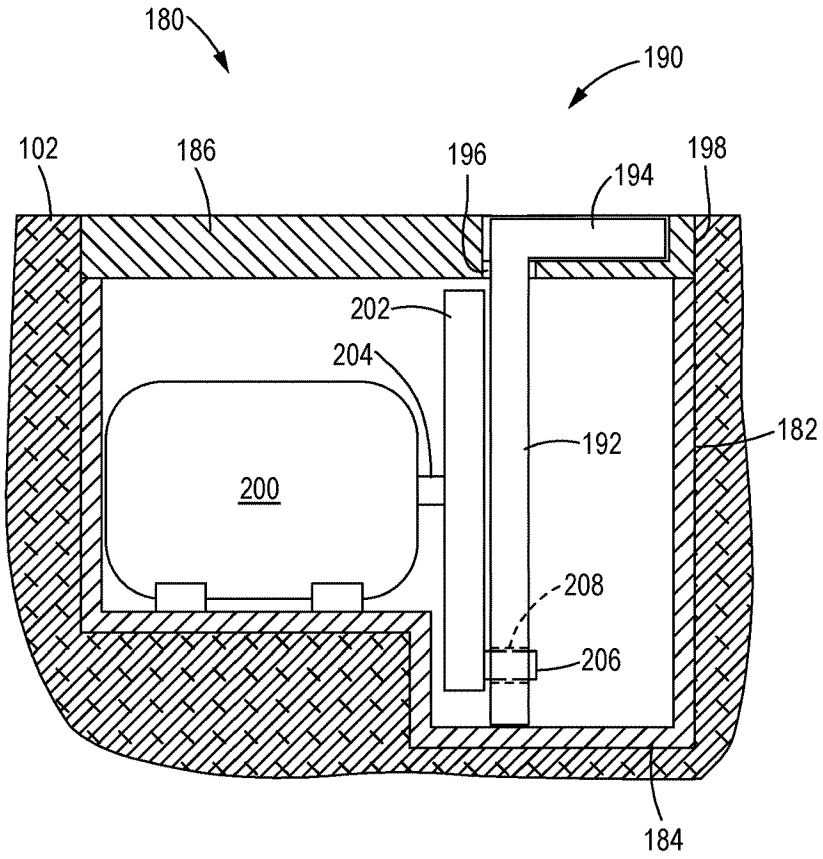
FIG. 20 is the partial cross-sectional view of FIG. 18 with the base slat locking bracket in a bracket retracted position.
Figure 19:
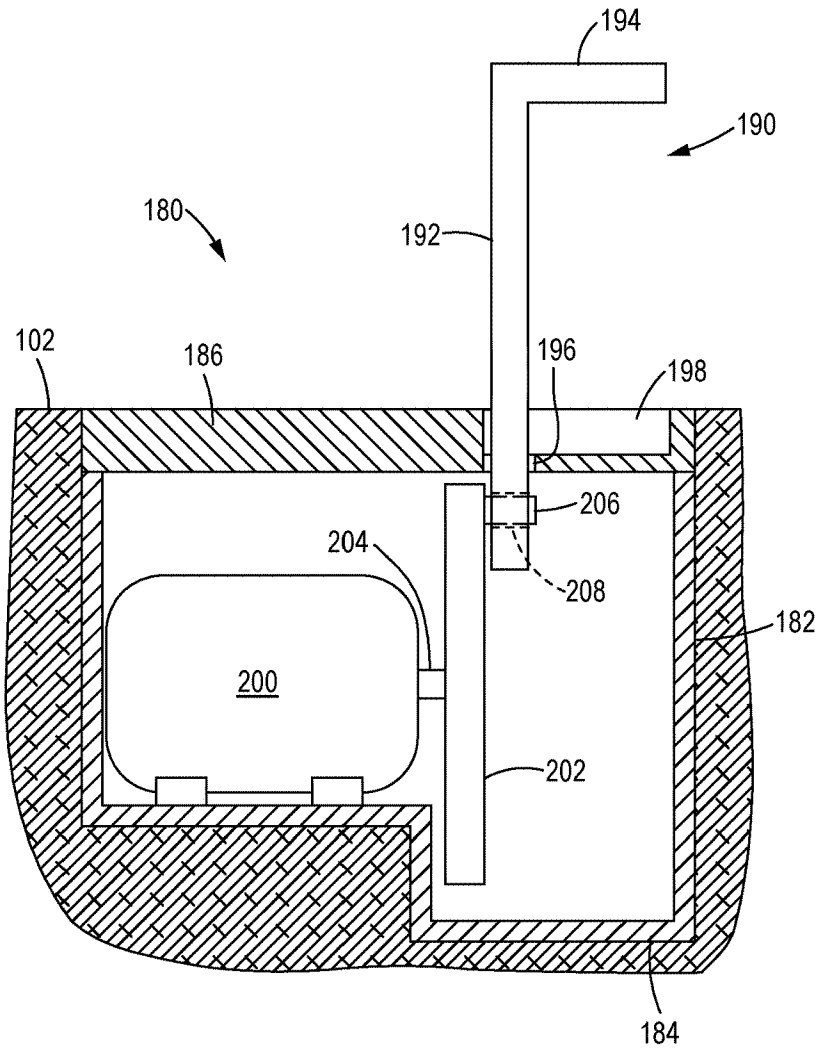
FIG. 19 is a partial cross-sectional side view of a locking bracket assembly in accordance with the present disclosure installed in the opening bottom wall and with a base slat locking bracket in a base slat locking position.

FIGS. 19 and 20 illustrate a further embodiment wherein a base slat pry stopper is permanently mounted in the opening bottom wall 102 but is movable between a base slat locking position where the base slat 46 can be engaged by the base slat engagement portion and a bracket retracted position where the base slat pry stopper is not an obstruction in the opening. The base slat pry stopper is provided in the form of a locking bracket assembly 180 that is installed within a locking bracket assembly recess 182 in the opening bottom wall 102. The locking bracket assembly 180 may include an assembly housing 184 that is inserted into the locking bracket assembly recess 182, and an assembly cover 186 that covers an open top end of the assembly housing 184. When installed, the assembly cover 186 is approximately flush with the opening bottom wall 102 to provide a continuous level surface at the bottom of the opening.

The locking bracket assembly 180 includes a base slat locking bracket 190 have a base slat engagement portion in the form of a bracket back wall 192 and a bracket top wall 194 similar to the bracket back wall 116 and the bracket top wall 118 as described above. In the present embodiment, however, the bracket back wall 192 may be extended downward to pass through a back wall slot 196 in the assembly cover 186 and into the assembly housing 184. The back wall slot 196 may be disposed within a top wall recess 198 in the assembly cover 186. The top wall recess 198 is configured to receive the bracket top wall 194 when the base slat locking bracket 190 is in the bracket retracted position shown in FIG. 19. Consequently, the top wall recess 198 has a depth that is at least equal to a thickness of the bracket top wall 194 so that the bracket top wall 194 is at or below the surface of the opening bottom wall 102 when the base slat locking bracket 190 is retracted.

One example of a deployment mechanism for moving the base slat locking bracket 190 between the base slat locking position of FIG. 19 and the bracket retracted position of FIG. 20 is contained within the assembly housing 184. The deployment mechanism in this embodiment includes a rotary actuator such as an electric motor 200 mounted to a wall of the assembly housing 184, and a wheel 202 mounted on a shaft 204 of the electric motor 200. The wheel 202 has a dowel 206 extending therefrom parallel to a rotational axis of the wheel 202. The dowel 206 is inserted through a horizontally elongated dowel slot 208 through the bracket back wall 192.

The electric motor 200 may be operatively connected to a power source (not shown) and a multi-position switch (not shown). When the switch is displaced to a first position, the electric motor 200 rotates the wheel 202 to the position shown in FIG. 19, and the base slat locking bracket 190 is extended to the base slat locking position. When the switch is displaced to a second position, the electric motor 200 rotates the wheel 202 back to the position shown in FIG. 20, and the base slat locking bracket 190 is retracted through the back wall slot 196 to the bracket retracted position. As the wheel 202 rotates, the dowel 206 is free to slide horizontally within the dowel slot 208. The switch may also have a neutral position where the electric motor 200 is electrically disconnected from the power source.

As discussed above, the locking bracket assembly 180 is exemplary of an arrangement for extending and retracting a base slat pry stopper that is install in the opening bottom wall 102. The electric motor 200 and the wheel 202 could be replaced by other types of linear or rotary actuators and appropriate connecting linkages for translating the motion of the actuator into the movement of the base slat locking bracket 190 between the base slat locking position and the bracket retracted position. Such actuators can be mechanical, electro-mechanical, electrical, pneumatic, hydraulic or the like. Additionally, alternative locking bracket assemblies can cause the base slat locking bracket 190 to move linearly as shown in the present example, or to move through any appropriate linear, curved or complex path of motion between the base slat locking position and the bracket retracted position.

The switch for the locking bracket assembly 180 may be located in any convenient location for operation by an operator opening and closing the rolling shutter assembly 10. In some implementations, a single switch may be used to control the operation of both the drive motor of the rolling shutter assembly 10 and the electric motor 200 of the locking bracket assembly 180. In such embodiments, the electric motor 200 may operate to extend the base slat locking bracket 190 as the drive motor unrolls the shutter curtain 30, and the electric motor 200 may operate to retract the base slat locking bracket 190 to the opening bottom wall 102 as the drive motor rolls the shutter curtain 30 onto the shutter support member 20. Alternatively, control of the locking bracket assembly 180 and/or the rolling shutter assembly 10 may be integrated into a security system for the facility such that the base slat locking bracket 190 and/or the shutter curtain 30 are deployed when the security system is turned on and retracted when the security system is turned off. Further alternative deployment systems for base slat pry stoppers in accordance with the present disclosure will be apparent to those skilled in the art and are contemplated by the applicant.

INDUSTRIAL APPLICABILITY

The base slat pry stoppers as illustrated and described herein, and alternative embodiments thereto, provide devices using the advantage of the connection to the ground to catch the base slat 46 of the shutter curtain 30 when a breach is attempted by prying up the base slat 46, and to prevent the base slat 46 from being raised above the opening bottom wall 102 to permit undesired access through the opening. These security improvements can be provided without the need for modifying the components of the rolling shutter assembly. This allows base slat pry stoppers to be retrofit into existing installations of rolling shutter assemblies. The base slat pry stopper can be permanently attached to the opening bottom wall 102 when permissible and not creating an obstruction for ingress and egress through the opening. Where permanent attachment of the base slat pry stopper would create an impermissible obstruction, the base slat pry stopper may be removably mounted to the opening bottom wall 102, or installed with an actuation device that can extend the base slat pry stopper when needed to secure the shutter curtain 30 over the opening and retract the base slat pry stopper when the shutter curtain 30 is rolled up to permit passage through the opening.

While the preceding text sets forth a detailed description of numerous different embodiments, it should be understood that the legal scope of protection is defined by the words of the claims set forth at the end of this patent. The detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims defining the scope of protection.

It should also be understood that, unless a term was expressly defined herein, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to herein in a manner consistent with a single meaning, that is done for sake of clarity only so as to not confuse the reader, and it is not intended that such claim term be limited, by implication or otherwise, to that single meaning.

What is claimed is:

1. A rolling shutter assembly for covering an opening of a structure, the opening having an opening top wall, an opening bottom wall and oppositely disposed opening side walls, the rolling shutter assembly comprising: a shutter support member mounted at the opening top wall; a shutter curtain coupled to the shutter support member, the shutter curtain comprising a plurality of individual slats and a plurality of hinges interconnecting the plurality of individual slats, with a bottommost slat being a base slat having a base slat bottommost edge extending across substantially an entire major length of the base slat; a pair of side tracks each having a U-shaped channel, each of the pair of side tracks mounted to a corresponding one of the opening side walls such that ends of the plurality of individual slats are received within the U-shaped channels when the shutter curtain is unrolled from the shutter support member to cover the opening, and wherein the base slat is disposed proximate the opening bottom wall when the shutter curtain is unrolled; and a base slat locking bracket mounted to the opening bottom wall on an interior side of the structure and the shutter curtain, between the pair of side tracks and at a position to engage the base slat inward from each of the side tracks, wherein the base slat locking bracket is positioned when mounted to the opening bottom wall so that the base slat can move upward and downward past the base slat locking bracket when the shutter curtain is rolled onto and unrolled from the shutter support member when no force is applied from an exterior side of the shutter curtain to cause the base slat to deflect toward the interior side of the structure and the shutter curtain, and wherein the base slat locking bracket receives and engages the base slat to prevent the base slat from deflecting upward away from the opening bottom wall and inward toward the interior side of the structure when a force applied from the exterior side of the shutter curtain causes the base slat to deflect toward the interior side of the structure and the shutter curtain and into engagement with the base slat locking bracket, wherein a portion of the base slat engaged by the base slat locking bracket does not move vertically relative to the rest of the base slat, and wherein the base slat is engaged by the base slat locking bracket above the base slat bottommost edge.

2. The rolling shutter assembly of claim 1, wherein the base slat locking bracket comprises:

a bracket back wall extending upward from the opening bottom wall; and a bracket top wall extending from the bracket back wall above the opening bottom wall and toward the exterior side of the shutter curtain and the structure, wherein the bracket top wall and the opening bottom wall define a base slat opening receiving the base slat when the base slat is deflected toward the interior side of the shutter curtain and the structure.

3. The rolling shutter assembly of claim 2, wherein the base slat locking bracket comprises a bracket base plate mounted to the opening bottom wall, wherein the bracket back wall extends upward from the bracket base plate.

4. The rolling shutter assembly of claim 1, wherein the base slat locking bracket is movable between a base slat locking position wherein the base slat locking bracket extends into the opening and will receive the base slat, and a base slat retracted position wherein the base slat locking bracket is retracted toward the opening bottom wall and does not extend into the opening and will not receive the base slat.

5. The rolling shutter assembly of claim 1, wherein the base slat locking bracket is removably mounted to the opening bottom wall.

6. The rolling shutter assembly of claim 5, wherein a bracket retention member extends upward from the opening bottom wall and has a retention shank attached to the opening bottom wall and having a shank width and a retention head disposed above the opening bottom wall and having a head width that is greater than the shank width, and wherein the base slat locking bracket comprises a bracket base plate having a bracket retention slot with a receiving section with a receiving section width that is greater than the head width, and a locking section with a locking section width that is less than the head width and greater than the shank width, wherein the base slat locking bracket is mounted to the opening bottom wall by lowering the base slat locking bracket with the receiving section receiving the retention head and moving the base slat locking bracket parallel along the opening bottom wall to dispose the retention shank within the locking section of the bracket retention slot so that the retention head engages the bracket base plate to prevent the base slat locking bracket from moving upward from the opening bottom wall.

7. The rolling shutter assembly of claim 5, comprising a bracket retention plate anchored to the opening bottom wall and defining a bracket retention slot, wherein the base slat locking bracket is removably mounted to the opening bottom wall by inserting a portion of the base slat locking bracket into the bracket retention slot whereby the bracket retention plate engages the portion of the base slat locking bracket to prevent the portion of the base slat locking bracket from pulling out of the bracket retention slot when the base slat locking bracket engages the base slat.

8. The rolling shutter assembly of claim 1, wherein the base slat comprises a base slat body extending from the base slat toward the interior of the structure such that the base slat body is received and engaged by the base slat locking bracket to prevent the base slat from deflecting upward away from the opening bottom wall when the force is applied and the base slat is deflected.

9. A method for covering an opening of a structure to prevent ingress into the structure through the opening, wherein a rolling shutter assembly is mounted at the opening, the rolling shutter assembly having a shutter support member mounted at an opening top wall, a shutter curtain coupled to the shutter support member and having a plurality of individual slats and a plurality of hinges interconnecting the plurality of individual slats, with a bottommost slat being a base slat having a base slat bottommost edge extending across substantially an entire major length of the base slat, and a pair of side tracks each having a U-shaped channel, each of the pair of side tracks mounted to a corresponding one of opening side walls such that ends of the plurality of individual slats are received within the U-shaped channels when the shutter curtain is unrolled from the shutter support member to cover the opening, and wherein the base slat is disposed proximate an opening bottom wall when the shutter curtain is unrolled, the method for covering comprising: mounting a base slat locking bracket to the opening bottom wall on an interior side of the structure and the shutter curtain, between the pair of side tracks and at a position to engage the base slat inward from each of the side tracks, wherein the base slat locking bracket is positioned when mounted so that the base slat can move upward and downward past the base slat locking bracket when the shutter curtain is rolled onto and unrolled from the shutter support member when no force is applied from an exterior side of the shutter curtain to cause the base slat to deflect toward the interior side of the structure and the shutter curtain: and engaging the base slat by the base slat locking bracket to prevent the base slat from deflecting upward away from the opening bottom wall and inward toward the interior side of the structure when the shutter curtain is unrolled and a force applied from the exterior side of the shutter curtain causes the base slat to deflect toward the interior side of the structure and the shutter curtain and into engagement with the base slat locking bracket, wherein a portion of the base slat engaged by the base slat locking bracket does not move vertically relative to the rest of the base slat, and wherein the base slat is engaged by the base slat locking bracket above the base slat bottommost edge.

10. The method of claim 9, comprising:

unrolling the shutter curtain to dispose the base slat proximate the opening bottom wall; and engaging the pair of side tracks at the ends of the base slat to prevent the ends of the base slat from displacing upward away from the opening bottom wall.

11. The method of claim 9, wherein mounting the base slat locking bracket to the opening bottom wall comprises bolting the base slat locking bracket to the opening bottom wall.

12. The method of claim 9, wherein mounting the base slat locking bracket to the opening bottom wall comprises movably mounting the base slat locking bracket to the opening bottom wall so that the base slat locking bracket is movable between a base slat locking position wherein the base slat locking bracket extends into the opening and will receive the base slat, and a base slat retracted position wherein the base slat locking bracket is retracted toward the opening bottom wall and does not extend into the opening and will not receive the base slat, and wherein the method for covering the opening of the structure comprises:

unrolling the shutter curtain to dispose the base slat proximate the opening bottom wall; and moving the base slat locking bracket to the base slat locking position.

13. The method of claim 9, wherein mounting the base slat locking bracket to the opening bottom wall comprises removably mounting the base slat locking bracket to the opening bottom wall.

14. The method of claim 9, wherein the base slat locking bracket comprises a bracket base plate, and wherein mounting the base slat locking bracket to the opening bottom wall comprises:

mounting a bracket retention plate to the opening bottom wall, wherein the bracket retention plate defines a bracket retention slot;

inserting a portion of the base slat locking bracket into the bracket retention slot whereby the bracket retention plate engages the portion of the base slat locking bracket to prevent the portion of the base slat locking bracket from pulling out of the bracket retention slot when the base slat locking bracket engages the base slat.

15. A base slat locking bracket for locking a rolling shutter assembly installed to cover an opening of a structure having an opening top wall, an opening bottom wall and oppositely disposed opening side walls, the rolling shutter assembly including a shutter support member mounted at the opening top wall, a shutter curtain coupled to the shutter support member, the shutter curtain comprising a plurality of individual slats and a plurality of hinges interconnecting the plurality of individual slats, with a bottommost slat being a base slat extending inward toward an interior of the structure and the shutter curtain and having a base slat bottommost edge extending across substantially an entire major length of the base slat and, and a pair of side tracks each having a U-shaped channel, each of the pair of side tracks mounted to a corresponding one of the opening side walls such that ends of the plurality of individual slats are received within the U-shaped channels when the shutter curtain is unrolled from the shutter support member to cover the opening, and wherein the base slat is disposed proximate the opening bottom wall when the shutter curtain is unrolled, the base slat locking bracket comprising: a bracket base plate mounted to the opening bottom wall on an interior side of the structure and the shutter curtain; and a base slat engagement portion extending upward from the bracket base plate and above a top surface of the opening bottom wall, wherein the bracket base plate engages the base slat engagement portion to constrain the base slat engagement portion from movement upward away from the opening bottom wall and from movement toward the interior side of the structure, wherein the base slat engagement portion is positioned between the pair of side tracks and at a position when mounted to engage the base slat inward from each of the side tracks so that the base slat can move upward and downward past the base slat locking bracket when the shutter curtain is rolled onto and unrolled from the shutter support member when no force is applied from an exterior side of the shutter curtain to cause the base slat to deflect toward the interior side of the structure and the shutter curtain, and wherein the base slat engagement portion engages the base slat to prevent the base slat from deflecting upward away from the opening bottom wall and inward toward the interior side of the structure when a force applied from the exterior side of the shutter curtain causes the base slat to deflect toward the interior side of the structure and the shutter curtain and into engagement with the base slat engagement portion, wherein a portion of the base slat engaged by the base slat locking bracket does not move vertically relative to the rest of the base slat, and wherein the base slat is engaged by the base slat locking bracket above the base slat bottommost edge.

16. The base slat locking bracket of claim 15, wherein the base slat engagement portion comprises:

a bracket back wall extending upward from the bracket base plate; and a bracket top wall extending from the bracket back wall above the opening bottom wall and toward the exterior side of the shutter curtain and the structure, wherein the bracket top wall and the opening bottom wall define a base slat opening receiving the base slat when the base slat is deflected toward the interior side of the shutter curtain and the structure.

17. The base slat locking bracket of claim 15, wherein the bracket base plate is removably mounted to the opening bottom wall.

18. The base slat locking bracket of claim 17, wherein a bracket retention member extends upward from the opening bottom wall and has a retention shank attached to the opening bottom wall and having a shank width and a retention head disposed above the opening bottom wall and having a head width that is greater than the shank width, wherein the bracket base plate has a bracket retention slot with a receiving section with a receiving section width that is greater than the head width, and a locking section with a locking section width that is less than the head width and greater than the shank width, wherein the base slat locking bracket is mounted to the opening bottom wall by lowering the base slat locking bracket with the receiving section receiving the retention head and moving the base slat locking bracket parallel along the opening bottom wall to dispose the retention shank within the locking section of the bracket retention slot so that the retention head engages the bracket base plate to prevent the base slat locking bracket from moving upward from the opening bottom wall.

19. The base slat locking bracket of claim 17, comprising a bracket retention plate anchored to the opening bottom wall and defining a bracket retention slot, wherein the base slat locking bracket is removably mounted to the opening bottom wall by inserting a portion of the base slat locking bracket into the bracket retention slot whereby the bracket retention plate engages the portion of the base slat locking bracket to prevent the portion of the base slat locking bracket from pulling out of the bracket retention slot when the base slat locking bracket engages the base slat.

* * * * *